US009865935B2

(12) United States Patent
Miraftab et al.

(10) Patent No.: US 9,865,935 B2
(45) Date of Patent: Jan. 9, 2018

(54) PRINTED CIRCUIT BOARD FOR ANTENNA SYSTEM

(71) Applicants: Vahid Miraftab, Kanata (CA); Wenyao Zhai, Kanata (CA); Morris Repeta, Ottawa (CA)

(72) Inventors: Vahid Miraftab, Kanata (CA); Wenyao Zhai, Kanata (CA); Morris Repeta, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 292 days.

(21) Appl. No.: 14/721,195

(22) Filed: May 26, 2015

(65) Prior Publication Data

US 2016/0204514 A1 Jul. 14, 2016

Related U.S. Application Data

(63) Continuation-in-part of application No. 14/594,583, filed on Jan. 12, 2015.

(51) Int. Cl.

| | |
|---|---|
| ***H01Q 21/00*** | (2006.01) |
| ***H01Q 1/24*** | (2006.01) |
| *H01Q 21/06* | (2006.01) |

(52) U.S. Cl.

CPC ..... *H01Q 21/005* (2013.01); *H01Q 1/243* (2013.01); *H01Q 1/246* (2013.01); *H01Q 21/065* (2013.01)

(58) Field of Classification Search

CPC H01Q 5/40; H01Q 5/42; H01Q 13/06; H01Q 21/064; H01Q 21/065; H01Q 1/246; H01Q 21/005

(Continued)

(56) References Cited

U.S. PATENT DOCUMENTS 8,159,316 B2 * 4/2012 Miyazato ..... G01S 7/032 333/239
8,350,771 B1 * 1/2013 Zaghloul ..... H01Q 9/0435 343/700 MS (Continued)

FOREIGN PATENT DOCUMENTS

CN 201673998 12/2010

OTHER PUBLICATIONS

Ghassemi et al., "Millimeter-Wave Integrated Pyramidal Horn Antenna Made of Multilayer Printed Circuit Board (PCB) Process," IEEE Transactions on Antennas and Propagation, vol. 60, No. 9, Sep. 2012.

(Continued)

*Primary Examiner* — Dameon E Levi
*Assistant Examiner* — Jennifer F Hu

(57) ABSTRACT

A Printed Circuit Board (PCB) comprising various integral components and method of manufacture are provided. The PCB includes a Substrate Integrated Waveguide (SIW), integrated waveguide antennas disposed above the SIW, apertures formed in SIW for coupling with the waveguide antennas, a transmission line routed above the SIW and using the SIW as a ground plane thereof, and further antennas, integrated into the PCB and disposed above and coupled to the transmission line. The SIW and the transmission line may be branched structures for feeding corresponding arrays of waveguide antennas and further antennas. Coplanar waveguides may also be integrated into the PCB and coupled to the SIW and the transmission line via integral impedance matching structures. PCB feature re-use and component interleaving may provide for a desirable and manufacturable PCB structure.

22 Claims, 17 Drawing Sheets

(58) Field of Classification Search
USPC ..... 343/725
See application file for complete search history.

(56) References Cited

U.S. PATENT DOCUMENTS

| | | | | |
|---|---|---|---|---|
| 9,653,810 | B2 * | 5/2017 | Luk | H01Q 9/065 |
| 9,711,860 | B2 * | 7/2017 | Ying | H01Q 13/00 |
| 2001/0015701 | A1 | 8/2001 | Shigekazu et al. | |
| 2004/0004571 | A1 | 1/2004 | Adachi et al. | |
| 2008/0074338 | A1 | 3/2008 | Vacanti | |
| 2010/0245204 | A1 | 9/2010 | Lee et al. | |
| 2012/0293279 | A1 | 11/2012 | Gong et al. | |
| 2014/0240186 | A1 | 8/2014 | Zhou et al. | |
| 2015/0042513 | A1 | 2/2015 | Foo et al. | |
| 2016/0006118 | A1 * | 1/2016 | Maruyama | H01Q 13/02 343/702 |
| 2016/0028162 | A1 * | 1/2016 | Ou | H01Q 1/2283 343/905 |
| 2017/0047658 | A1 * | 2/2017 | Ying | H01Q 1/521 |

OTHER PUBLICATIONS

Bhardwaj et al., "C-shaped, E-shaped and U-slotted Patch Antennas: Size, Bandwidth and Cross-Polarization Characterizations", Electrical Engineering Department, University of California, Los Angeles (UCLA), Los Angeles, CA 90095, USA, Mar. 26-30, 2012.

Yang et al., 'Wide-Band E-Shaped Patch Antennas for Wireless Communications' IEEE Transactions on Antennas and Propagation, vol. 49, No. 7 Jul. 2001.

Kai Fong Lee, Kwai Man Luk, 'Microstrip Patch Antennas' Imperial College Press, 2010, pp. 229-253.

M. Wei, H. Deng, H. Sun and Y. Liu, "Design of an X/Ka Dual-Band Co-Aperture Broadband Microstrip Antenna Array," Microwave Technology & Computational Electromagnetics (ICMTCE), pp. 217-220, May 22-25, 2011.

Antti E I Lamminen, Jussi Saily and Antti R. Aimpari "60-GHz Patch Antennas and Arrays on LTCC with Embedded-Cavity Substrates" IEEE Transactions on Antennas and Propagation, vol. 56 No. 9 Sep. 2008.

David J. Chung, Arnaud L. Amadjikpe and John Papapolymerou, "Multilayer Integration of Low-Cost 60-GHz Front-End Transceiver on Organic LCP" IEEE Antennas and Wireless Propagation Letters, vol. 10, 2011, pp. 1329-1332.

Xiaoxiong Gu, Duixian Liu, Christian Baks, Alberto Valdes-Garcia, Ben Parker, MD R Islam, Arun Natarajan and Scott K. Reynolds"A Compact 4-Chip Package with 64 Embedded Dual-Polarization Antennas for W-band Phased Array Transceivers" 2014 Electronic Components and Technology Conference, pp. 1272-1277.

International Search Report dated Mar. 14, 2016 for corresponding International Application No. PCT/CN2016/070661 filed Jan. 12, 2016.

* cited by examiner

PRINTED CIRCUIT BOARD FOR ANTENNA SYSTEM

CROSS-REFERENCE TO RELATED APPLICATIONS

This application is a continuation-in-part of U.S. patent application Ser. No. 14/594,583 filed Jan. 12, 2015. The foregoing application is incorporated by reference herein in its entirety.

FIELD OF THE INVENTION

The present invention pertains to the field of antennas and antenna feed structures implemented using Printed Circuit Boards (PCBs) and in particular to a PCB for an antenna system such as but not necessarily limited to a dual-band co-aperture antenna array.

BACKGROUND

Antennas and antenna arrays, including multi-band arrays, can be implemented using different types of antenna elements in close proximity. However, this also requires the antennas to be connected to appropriately closely-placed transmission line structures. Further, it is desirable to implement the antennas and transmission line structures as features within a Printed Circuit Board (PCB), for example in order to facilitate cost-effective mass manufacturability.

However, it is not straightforward to implement antenna structures and associated transmission lines within a PCB while balancing a variety of often conflicting constraints, such as cost, manufacturability, and performance constraints. This is particularly true at high frequencies such as microwave and millimeter wave (mmW) frequencies, where both antenna and transmission line design typically requires extensive consideration, and microwave engineering practices are commonly employed. The design of such a PCB is implemented in a PCB stackup, that is, the collective physical layout of multiple layers of the PCB.

Therefore there is a need for a PCB for an antenna system that is not subject to one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY

An object of embodiments of the present invention is to provide PCB for an antenna system and associated method of manufacture. In accordance with embodiments of the present invention, there is provided a Printed Circuit Board (PCB) comprising: a Substrate Integrated Waveguide (SIW) structure having a first conductive boundary disposed within a first conductive layer of the PCB, a second conductive boundary disposed within a second conductive layer of the PCB, and a plurality of first vias coupling the first conductive boundary to the second conductive boundary; at least one waveguide antenna disposed at least partially within further conductive layers of the PCB, the further conductive layers including a third conductive layer and a fourth conductive layer, wherein the second conductive layer is disposed between the first conductive layer and the third conductive layer, and wherein the third conductive layer is disposed between the second conductive layer and the fourth conductive layer; at least one aperture formed in the second conductive boundary of the SIW structure and aligned with the at least one waveguide antenna; a conductive trace of a transmission line, the conductive trace disposed within the third conductive layer, at least a portion of the conductive trace aligned overtop of the second conductive boundary of the SIW structure, the conductive trace routed around the at least one aperture; and at least one further antenna disposed at least partially within the fourth conductive layer and operatively coupled to the conductive trace.

In accordance with embodiments of the present invention, there is provided a method of manufacturing a PCB, the method comprising: forming a Substrate Integrated Waveguide (SIW) structure having a first conductive boundary disposed within a first conductive layer of the PCB, a second conductive boundary disposed within a second conductive layer of the PCB, and a plurality of first vias coupling the first conductive boundary to the second conductive boundary; forming at least one aperture in the second conductive boundary of the SIW structure and aligned with the at least one waveguide antenna; forming at least one waveguide antenna disposed at least partially within further conductive layers of the PCB, the further conductive layers including a third conductive layer and a fourth conductive layer, wherein the second conductive layer is disposed between the first conductive layer and the third conductive layer, and wherein the third conductive layer is disposed between the second conductive layer and the fourth conductive layer; forming a conductive trace of a transmission line, the conductive trace disposed within the third conductive layer, at least a portion of the conductive trace aligned overtop of the second conductive boundary of the SIW structure thereby facilitating operation of the transmission line, the conductive trace routed around the at least one aperture; and forming at least one further antenna disposed at least partially within the fourth conductive layer and operatively coupled to the transmission structure through a further via.

In accordance with embodiments of the present invention, there is provided a wireless communication device comprising a PCB as described herein.

BRIEF DESCRIPTION OF THE FIGURES

Further features and advantages of the present invention will become apparent from the following detailed description, taken in combination with the appended drawings, in which.

It will be noted that throughout the appended drawings, like features are identified by like reference numerals.

DETAILED DESCRIPTION

Definitions

Figure 1:
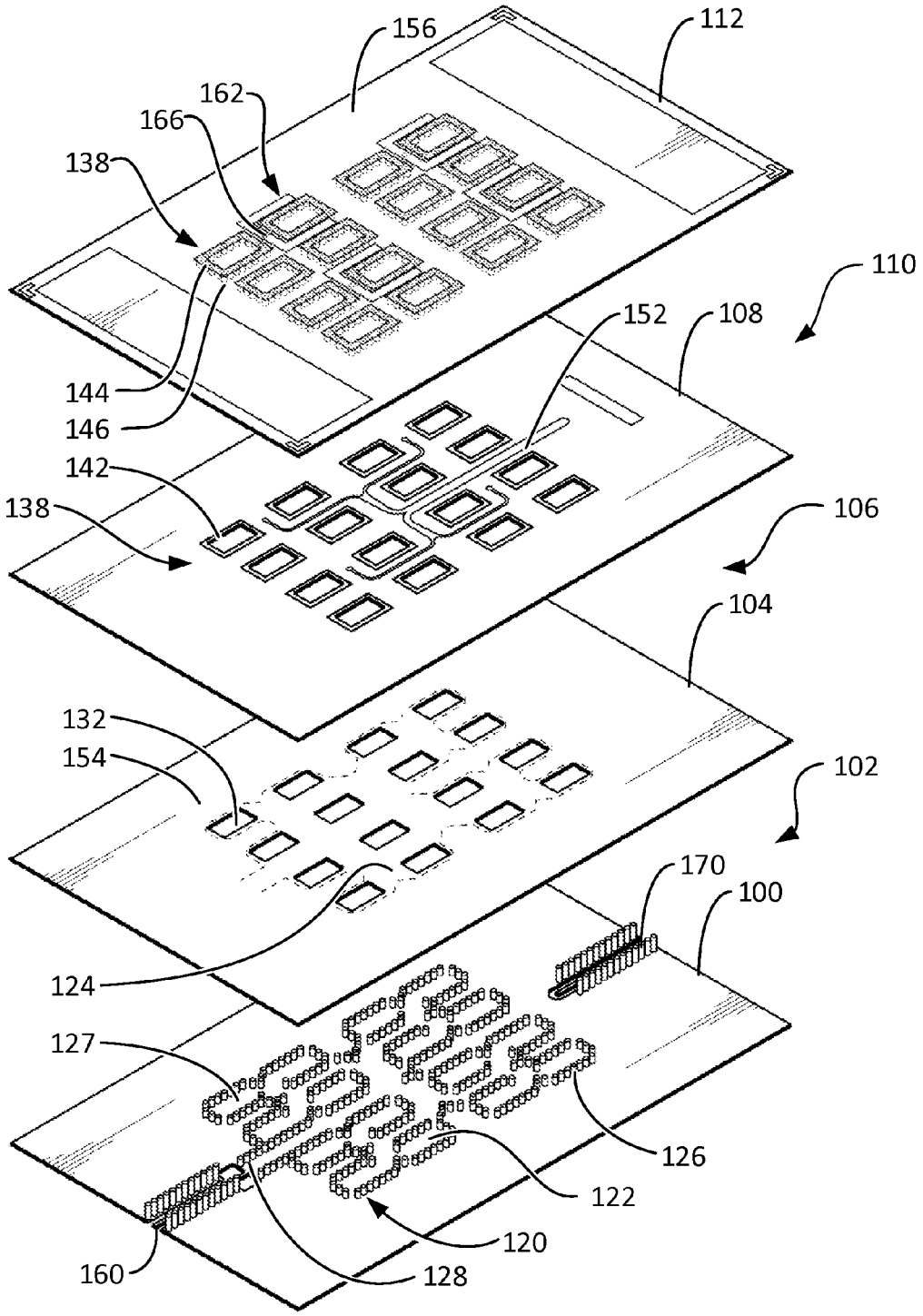
FIG. 1 illustrates an exploded perspective view of a PCB provided in accordance with embodiments of the present invention.

As used herein, the term "about" should be read as including variation from the nominal value, for example, a +/−10% variation from the nominal value. It is to be understood that such a variation is always included in a given value provided herein, whether or not it is specifically referred to.

As used herein, the term "signal transmission structure" refers to an electrical structure which is used to propagate and direct electromagnetic signals at appropriate radio frequencies, such as microwave and millimeter wave (mmW) frequencies. Such structures may include but are not limited to Substrate Integrated Waveguide (SIW), Coplanar Waveguide (CPWG), symmetric or offset Stripline (SLIN), Microstrip, and the like.

Unless defined otherwise, all technical and scientific terms used herein have the same meaning as commonly understood by one of ordinary skill in the art to which this invention belongs.

Embodiments of the present invention relate to a PCB comprising at least one signal transmission structure for coupling to at least one antenna or antenna array. Embodiments of the present invention relate to a PCB comprising at least two signal transmission structures for coupling to at least two antennas or antenna arrays. The antennas or antenna arrays may also be implemented in the PCB. In some embodiments, plural different types of antennas and signal transmission structures may be interleaved to provide for a co-aperture antenna array.

Further in various embodiments, a first signal transmission structure may be operatively coupled to a first subset of one or more antennas to provide a first functional portion of the PCB, and a second signal transmission structure may be operatively coupled to a second subset of one or more further antennas to provide a second functional portion of the PCB. As will become readily apparent herein, the first signal transmission structure may include a SIW structure and the first subset of antennas may include one or more aperture antennas, whereas the second signal transmission structure may include a stripline structure and the second subset of antennas may include one or more patch antennas coupled to the stripline structure using vias. When the first subset of antennas includes multiple antennas or the second subset of antennas includes multiple antennas, or both, the first signal transmission structure, the second signal transmission structure, or both, may be branched structures, such as symmetric branched structures.

Further with respect to the above, the first functional portion of the PCB may be interleaved with the second functional portion of the PCB. For example, a given conductive layer of the PCB may include features corresponding to both the first functional portion and the second functional portion of the PCB, such as conductive traces and via pads, and these components may be arrange in an interleaved manner such that at least one feature of the first portion lies between two given features of the second portion and/or vice-versa. This may facilitate provision of a co-aperture antenna array with interleaved antenna elements fed by two different signal transmission structures, for example. Various embodiments of incorporate one or both of a waveguide structure and a multi-conductor transmission line structure, such as a microstrip or stripline, which correspond to two different types of signal transmission structures. In some embodiments, the two different signal transmission structures operate according to different modes, for example the SIW may propagate signals by way of a Transverse Electric (TE) or a Transverse Magnetic (TM) mode, whereas the electromagnetic propagation mode for a multi-conductor transmission line may be a Transverse Electromagnetic (TEM) mode or a quasi-TEM mode. The use of different modes to feed different antenna elements may assist in isolating the different antenna elements from one another. For example, since a TEM mode and/or frequencies propagated by the corresponding multi-conductor transmission line is generally not sustained by a waveguide, the transmission line feed signal, and/or harmonics thereof, may be impeded from coupling onto the waveguide. Similarly, since the TE and TM modes may not be as readily sustained by a stripline, microstrip, or similar multi-conductor transmission line, the waveguide feed signal, and/or harmonics thereof, may be impeded from coupling onto the transmission line.

Further with respect to the above, the first functional portion of the PCB may share one or more common or integrated features with the second functional portion of the PCB. For example, a ground plane on a given PCB layer may operate as both a boundary of a SIW signal transmission structure and a ground plane of a stripline signal transmission structure.

In accordance with an embodiment of the present invention, there is provided a Printed Circuit Board (PCB) having a Substrate Integrated Waveguide (SIW) structure and associated at least one waveguide antenna, along with a transmission line and associated at least one further antenna. The SIW has a first conductive boundary disposed within a first conductive layer of the PCB, a second conductive boundary disposed within a second conductive layer of the PCB, and a plurality of first vias coupling the first conductive boundary to the second conductive boundary. The at least one waveguide antenna is disposed at least partially within further conductive layers of the PCB, the further conductive layers including a third conductive layer and a fourth conductive layer. In particular, the second conductive layer is disposed between the first conductive layer and the third conductive layer, and wherein the third conductive layer is disposed between the second conductive layer and the fourth conductive layer. At least one aperture is formed in the second conductive boundary of the SIW structure and aligned with the at least one waveguide antenna. Each aperture is provided for coupling energy from the SIW structure to an associated adjacent waveguide antenna. A conductive trace of the transmission line is disposed within the third conductive layer, such that at least a portion of the conductive trace is aligned overtop of the second conductive boundary of the SIW structure, thereby facilitating operation of the transmission line, the conductive trace routed around the at least one aperture. The at least one further antenna is disposed at least partially within the fourth conductive layer and operatively coupled to the conductive trace, for example through a further via.

PCB Stackup

FIG. 1 illustrates an exploded perspective view of a PCB provided in accordance with embodiments of the present invention. The PCB comprises a first conductive layer 100 and a second conductive layer 104, as well as two further conductive layers, disposed overtop of the first and second conductive layers, namely a third conductive layer 108 and a fourth conductive layer 112. Each of these conductive layers may be configured appropriately, for example by etching of features therein in accordance with standard PCB fabrication techniques, in order to provide a desired pattern of conductive traces. The second conductive layer lies between the first and third conductive layers, and the third conductive layer lies between the second and fourth conductive layers. The PCB further comprises a first insulating layer 102 between the first and second conductive layers, a second insulating layer 106 between the second and third conductive layers, and a third insulating layer 110 between the third and fourth conductive layers. Thus, the PCB may in some embodiments be a four layer PCB, although other numbers of layers may also be possible. Further conductive layers and further insulating layers may be provided, for example below the first conductive layer or potentially between two or more of the aforementioned first, second, third and fourth conductive layers.

As illustrated, a Substrate Integrated Waveguide (SIW) structure 120 is provided which spans the first and second conductive layers 100, 104. The SIW structure 120 includes a first conductive boundary 122 disposed on the first conductive layer 100, a second conductive boundary 124 disposed on the second conductive layer 104, and a via fence boundary formed from a plurality of first vias 126 passing between at least the first conductive layer 100 and the second conductive layer 104 to couple the first conductive boundary to the second conductive boundary. A region of dielectric material enclosed by the first and second conductive boundaries and the via fence corresponds to the interior of the SIW. Signals such as radiofrequency, microwave and/or millimeter wave signals may be propagated through the SIW with appropriately designed SIW dimensions as would be readily understood by a worker skilled in the art, and sizing and configuration of the SIW may depend in part on the frequency range of the signals to be propagated.

In some embodiments, one or both of the first conductive boundary 122 and the second conductive boundary 124 may comprise an area of conductive material that terminates substantially at the via fence boundary. Thus, outside of the via fence boundary may lie an area that is at least partially free of conductive material and/or which may be used for disposal of other circuit traces or features. As such, the first and second conductive boundaries may be electrically isolated from other features on their respective PCB layers. In other embodiments, one or both of the first conductive boundary 122 and the second conductive boundary 124 may comprise be conductively integrated with areas of conductive material that extends beyond the via fence boundary. As such, one or both of the first boundary or the second boundary may be integrated with a larger conductive ground plane which extends beyond the via fence boundary in the appropriate PCB layer.

As illustrated in FIG. 1, the SIW may be formed as a branched structure. Such an SIW includes a plurality of branches, each of which terminates at a respective location, such as location 127, aligned with a corresponding one of a plurality of waveguide antennas. The terminal locations may correspond to antenna ports of the SIW, while a separate port 128 of the SIW may correspond to a corresponding port of the SIW which may be coupled to an RF Front-end or similar component. Alignment in the above sense may refer to vertical alignment, that is, the respective locations are substantially directly below the waveguide antennas, where the term "below" is used in relation to a frame of reference, relative to the PCB, in which the first layer of the PCB is considered lower than the second layer, etc., and in each PCB layer extends in the horizontal direction and different PCB layers are disposed adjacently in the vertical direction. In some embodiments, and as illustrated, each path of the branched structure may have substantially the same length. This may facilitate driving of the plurality of antennas substantially in phase and/or with substantially equal power, for example. Further, each path of the branched structure may have the same number of corners. As illustrated, each branching point of the branched structure is a bifurcation or two-way branch. However, other topologies, such as n-way branches (n>2) may also be used.

Alternatively, in some embodiments, the SIW may be an unbranched structure. For example, when the SIW is coupled to a single waveguide antenna there may be no need for branching. As another example, the SIW may be coupled to plural waveguide antennas at different locations along its length, for example through apertures formed in the SIW at these different locations, and the SIW may follow a straight or tortuous path. However, when an unbranched SIW is coupled to plural waveguide antennas, additional measures may be required to address considerations such as power balancing, phasing, and the like.

Further with reference to FIG. 1, one or more coupling apertures such as aperture 132 are formed in the second conductive boundary of the SIW structure and respectively aligned with one or more waveguide antennas such as waveguide antenna 138. Alignment may be such that the aperture is located at substantially the same x-y coordinates of the PCB as its corresponding waveguide antenna, but on a different layer of the PCB. Some limited offset of the alignment may be tolerated. A plurality of apertures and waveguide antennas are illustrated in FIG. 1 in a rectangular grid array. The apertures function as coupling slots for operatively coupling the respective ports of the SIW to waveguide antennas, such as waveguide antenna 138, located above the apertures and described below. The apertures facilitate flow of electromagnetic energy between the SIW and the waveguide antennas, thereby operatively coupling the SIW to the waveguide antennas for radio transmission and/or reception. In one embodiment, the coupling apertures 132 are smaller in size than the waveguide antennas 138, which may provide for an effect similar to flaring of a horn antenna, for example which provides a more gradual transition structure to match the impedance of the SIW to the impedance of free space.

The waveguide antennas, such as waveguide antenna 138, are disposed at least partially within the further conductive layers of the PCB, namely the third conductive layer 108 and the fourth conductive layer 112. The coupling apertures, such as aperture 132 in the second conductive layer, may also in some embodiments be considered to be part of its associated waveguide antenna. The waveguide antennas generally comprise a conductive perimeter surrounding a non-conductive aperture, for example which includes dielectric material of the PCB. In some embodiments, the waveguide antenna may be regarded functionally as a horn antenna, which is either flared or unflared, and which is implemented as a set of conductive features embedded within the PCB. Impedance matching features, such as a predetermined amount of flare, may be integrated into the waveguide antenna for example by appropriate shaping thereof. The size and dimensions of the waveguide antenna may be configured based at least in part on the wavelengths of the wireless signals to be transmitted and/or received, as would be readily understood by a worker skilled in the art.

In various embodiments, the waveguide antenna is implemented as conductive features embedded within the PCB as follows. A pair of aligned and concentric, closed conductive traces 142, 144, such as square or rectangular traces, are formed respectively on the third conductive layer and the fourth conductive layer to define the upper and lower edges of the antenna. A via fence located between the aligned conductive traces is provided, and further the conductive traces may facilitate correct fabrication of the via fence. Optionally, one of the pair of traces 142, 144 may be omitted in some embodiments, and subject to performance requirements. For an unflared waveguide antenna, the two closed traces may be vertically aligned and of the same dimensions. Further for the unflared waveguide antenna, a plurality of vias 146 may also be provided which form part of the waveguide antenna surface and may connect the two closed conductive traces at several locations. The closed conductive traces and the plurality of vias define a perimeter of a non-conductive region of the waveguide antenna. At least some of the vias may be blind vias passing only between the third layer and the fourth layer. Additionally or alternatively, at least some of the vias may pass to further layers, such as the first layer and/or the second layer, in which case only a portion of the via may connect the two closed conductive traces. The remainders of such vias may have other functionality, such as enclosing the area in the second insulating layer 106 between the waveguide antenna and the corresponding aperture of the SIW.

In alternative embodiments, a flared waveguide antenna, such as is described in "Millimeter-Wave Integrated Pyramidal Horn Antenna Made of Multilayer Printed Circuit Board (PCB) Process," by N. Ghassemi and K. Wu, IEEE Transactions on Antennas and Propagation, Vol. 60, No. 9, September 2012, may be provided and implemented within the PCB. In other embodiments, the PCB may include a first portion of the waveguide antenna, such as an unflared portion, while a second portion of the waveguide antenna, such as a flared portion, may be provided as a component mounted to the PCB surface overtop of the first portion. Flaring of a waveguide antenna may be provided for by the use of a series of conductive enclosures, each defining an inner dielectric region which is progressively larger than the last. Each such conductive enclosure may comprise a closed conductive trace having vias extending therefrom. At least one conductive enclosure may comprise a closed conductive trace defining both an inner perimeter and an outer perimeter, with the outer perimeter coupled to vias extending vertically to the next larger conductive enclosure, and the inner perimeter coupled to vias extending in an opposite vertical direction.

The first functional portion of the PCB comprises the SIW, coupling apertures, and waveguide antennas as described above, optionally along with a Coplanar Waveguide coupled to the SIW as described elsewhere herein. The second functional portion of the PCB comprises a transmission line and further antennas coupled thereto, optionally along with another Coplanar Waveguide coupled to the transmission line. The transmission line may be a multiconductor transmission medium or structure, such as a stripline or microstrip, or a Coplanar Waveguide backed by a ground plane CPWG.

In various embodiments, at least part of the conductive boundary of the SIW, for example the second conductive boundary formed in the second conductive layer of the PCB, may also be used as part of the transmission line. Thus conductive traces of the transmission line, such as the center conductor of a stripline, may be aligned overtop of the conductive boundary of the SIW in order to re-use the conductive boundary of the SIW as a ground plane portion of the transmission line, thereby facilitating operation of the transmission line. This facilitates a re-use of PCB conductive features as well as integration of the two functional portions of the PCB which may improve compactness and simplicity of the PCB layout.

It is further noted that the conductive trace of the transmission line may be routed in order to mitigate interference with the waveguide antennas and coupling of the waveguide antennas to the SIW. For example, the conductive trace may be routed around the apertures formed in the SIW so as to avoid passing overtop of same.

FIG. 1 further illustrates a conductive trace 152 of the transmission line, which is disposed within the third conductive layer 108 of the PCB. A portion of the conductive trace 152 is aligned overtop of the second conductive boundary 124 of the SIW. In some embodiments, the second conductive boundary 124 may extend beyond the overall boundary of the SIW as illustrated to provide a ground plane extension 154 of the transmission line in regions where the transmission line is not routed directly overtop of the SIW. That is, the second conductive boundary of the SIW may be integral with a larger ground plane which extends beyond the SIW and which may serve at least in part as a ground plane of the transmission line. In addition, the PCB may include an upper conductive boundary 156 which lies proximate to the conductive trace 152. In various embodiments, the upper conductive boundary 156 may not lie over the entirety of the conductive trace, but rather may include significant gaps. In some embodiments, the upper conductive boundary 156 is formed at least in part of features in the fourth conductive layer 112 of the PCB, including upper portions 144 of the waveguide antennas and portions of the further antennas 162. Vias 146 and lower portions 142 of the waveguide antennas may also form part of the upper conductive boundary 156. Additional ground plane traces provided on the fourth conductive layer 112 may also be provided forming part of the upper conductive boundary.

In some embodiments, the conductive trace structure 152, the second conductive boundary 124, the upper conductive boundary 156 and optionally the ground plane extension 154 may collectively form a stripline transmission line. In some embodiments, and due to different thicknesses of the second and third insulating layers 106 and 110 of the PCB, the stripline may be regarded as an offset stripline or quasi-stripline. In some embodiments, and subject to performance requirements, the upper conductive boundary 156 may be omitted, in which case the transmission line may be regarded as a microstrip. Alternatively, the conductive trace 152 may be surrounded by a slot formed within the third conductive layer and a further conductive region formed surrounding the slot within the third conductive layer, thereby forming a ground plane backed Coplanar Waveguide transmission line.

The transmission line is operatively coupled to at least one further antenna, such as an antenna 162 disposed at least partially within the fourth conductive layer 112 of the PCB. The further antenna may be operatively coupled to the transmission line for example using a via 166 connected between the further antenna and the conductive trace 152 of the transmission line.

In various embodiments, the further antenna is a patch antenna disposed on the PCB surface, the body of the patch antenna located in a space adjacent to the waveguide antennas so as to avoid passing overtop of the waveguide antennas and/or coupling apertures of the SIW. In some embodiments, as illustrated in FIG. 1, the body of the patch antenna may define a perimeter of a cavity, also referred to as an interior region, in the plane of the fourth conductive layer. For example, the body of the patch antenna may be substantially C-shaped. Further, a neighbouring waveguide antenna may be aligned with the cavity defined by the patch antenna, for example such that the body of the patch antenna is disposed around part of a neighbouring waveguide antenna.

This configuration may provide for a co-aperture antenna array comprising two different sets of antenna elements which are interleaved with each other. The two sets of antenna elements may respectively correspond to two antenna arrays with overlapping apertures, and have an appropriate inter-element spacing for example as required for operation of each array within a given frequency band. For example, the inter-element spacing may be proportional to a center operating wavelength of the antenna array, the center operating wavelengths of the two co-aperture arrays may be substantially integer multiples of each other, and with inter-element spacing corresponding to the same integer multiples, thereby facilitating placement of the antenna elements of one array at regular intervals within the spaces between the antenna elements of the other array. The architecture of the two feed structures on separate layers, with one ground plane shared between two feed structures, can further facilitate independent coupling to the two interleaved antenna arrays within a PCB implementation.

In various embodiments, the transmission line may include a plurality of branches, each branch terminating at a respective location aligned with a corresponding one of a plurality of further antennas, such as patch antennas. The plurality of further antennas are disposed at least partially within the fourth conductive layer and operatively coupled to the transmission line through a respective plurality of vias. In some embodiments, the plurality of waveguide antennas are disposed in a first two-dimensional array, and the plurality of further antennas are disposed in a second two-dimensional array interleaved with the first two-dimensional array. This can provide for a co-aperture configuration of the two antenna arrays. Such a co-aperture configuration may be advantageous for example for reasons of compactness, and the like.

Various embodiments of the present invention provide for a PCB comprising, in four adjacent layers, a pair of co-aperture antenna arrays and feed structures for same. The two co-aperture antenna arrays comprise different types of antenna elements and feed structures, thereby potentially improving isolation. The compact four-layer configuration is achieved by appropriate interleaving of PCB features and by re-using certain features for multiple purposes. For example, the upper surface of a SIW and conductive features of the array of patch antennas and/or waveguide antennas may be re-used as a upper and lower ground planes of a transmission line. As another examples, vias of the SIW via fence may extend into and be re-used as vias of the waveguide antennas or for other purposes.

FIG. 1 also illustrates a Coplanar Waveguide backed by ground plane (CPWG) 160 operatively coupled to the SIW 120 via an input transition, and a further Coplanar Waveguide (CPWG) 170 operatively coupled to the conductive trace 152 of the transmission line via a further input transition. Further details of these transitions of the PCB are described elsewhere herein for example with respect to FIG. 6 and FIG. 7.

In some embodiments, at least some of the plurality of vias 126 may extend only between the third and fourth conductive layers. Additionally or alternatively, in some embodiments, at least some of the plurality of vias 126 may extend into further layers, for example from the first conductive layer to the fourth conductive layer. For example, some of the vias may be through vias having a first portion which forms part of the via fence boundary of the SIW, a second portion which forms part of the vias 146 of the waveguide antenna located directly above same. A third portion of such vias, lying between the first portion and the second portion and passing for example between the second conductive layer 104 and the third conductive layer 106, may surround and isolate the operative coupling between the SIW and the waveguide antenna. Such a configuration may simplify the PCB layout for example by avoiding or reducing use of blind vias, and by providing multiple functionalities for a through via.

Further, in some embodiments of the present invention, at least some of the vias forming part of the waveguide antenna and/or at least some of the vias forming part of the via fence boundary SIW may extend beyond the waveguide antenna or the via fence boundary, respectively. For example, vias, such as through vias, may include a first portion configured as part of the via fence of the SIW and a second portion which is configured as part of the boundary of a waveguide antenna disposed above the SIW and/or which is configured as part of a boundary surrounding a space between the SIW coupling aperture and the waveguide antenna. As another example, vias, such as through vias or blind vias, may include a first portion configured as part of the via fence of the SIW and a second portion which extends toward the waveguide antenna but does not necessarily electrically couple with the waveguide antenna. As yet another example, vias, such as through vias or blind vias, may include a first portion configured as part of the waveguide antenna boundary and a second portion which extends toward the SIW but does not necessarily electrically couple with the SIW. It is noted that such vias should not intrude into the SIW in a manner that blocks signal propagation through the SIW. Further, if such vias include a portion that initially intrudes into the SIW but which is planned to be back-drilled to remove the intruding portion, consideration should be made as to whether the void left by back-drilling negatively impacts signal propagation through the SIW. Use of peck-drilled vias may mitigate such concerns but typically adds cost and complexity to the manufacturing process. Vias as in the above examples may assist in inhibiting leakage of signals passing between the SIW and the waveguide antenna through the coupling aperture therebetween.

An analysis of various PCB configurations such as the configuration illustrated in FIG. 1 reveals that some but not all of the vias of the waveguide antenna elements may be substantially vertically aligned with some but not all of the vias of the SIW, and conversely that some but not all of the vias of the SIW may be substantially vertically aligned with some but not all of the vias of the waveguide antenna elements. The vias which are vertically aligned may be provided using through vias rather than blind vias. In embodiments, it may be possible to provide all of the vias defining the SIW via fence to be through vias, which are augmented with blind vias in order to complete the perimeters of the waveguide antennas.

Figure 2:
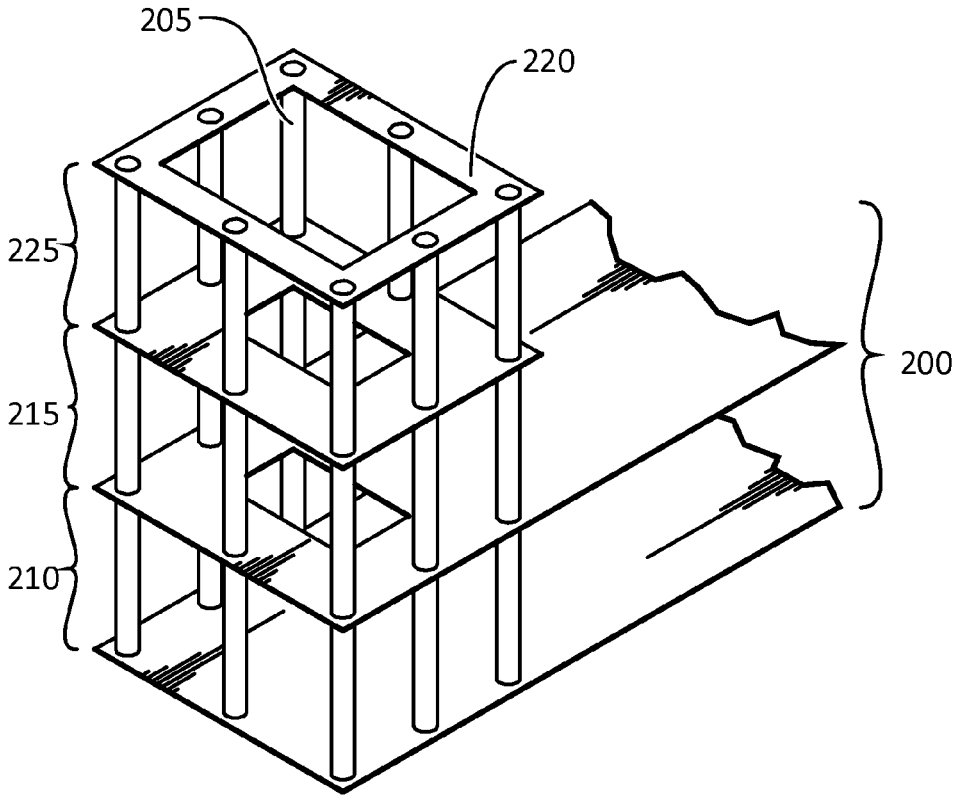
FIG. 2 illustrates a portion of a SIW provided in accordance with embodiments of the present invention.

FIG. 2 illustrates a portion of a SIW 200 having vias, such as example via 205 with a first portion 210 forming part of the SIW via fence, a second portion 215 forming a boundary around the region between the SIW and a waveguide antenna 220, and a third portion 225 forming part of the waveguide antenna boundary.

In some embodiments, the antenna array may be a dual-band antenna array. In various embodiments of the present invention, the first frequency band in which some antenna elements of the array operate is different from the second frequency band in which other antenna elements of the array operate. In various embodiments, the two frequency bands may be separated by a large frequency difference or a small frequency difference. In some embodiments, the two frequency bands may be at least partially overlapping. In some embodiments, the two operating frequencies correspond to a Local Multipoint Distribution Service (LMDS) frequency band, such as the 26 GHz to 31 GHz band and one or more E-band frequency bands, such as the 71 to 76 GHz band along with the 81 to 86 GHz band. In one embodiment, a representative frequency of the LMDS frequency band is about 28 GHz, and a representative frequency of the E-band is about 84 GHz. Notably the 84 GHz frequency is about three times the 28 GHz frequency, which corresponds to an integer multiple of the two representative frequencies. The patch antenna elements may operate in the LMDS frequency band, while the waveguide antenna elements may operate in the E-band. The signal transmission structures may be configured to propagate signals in the frequency ranges which are appropriate to the antennas to which they are operatively coupled.

Figure 3:
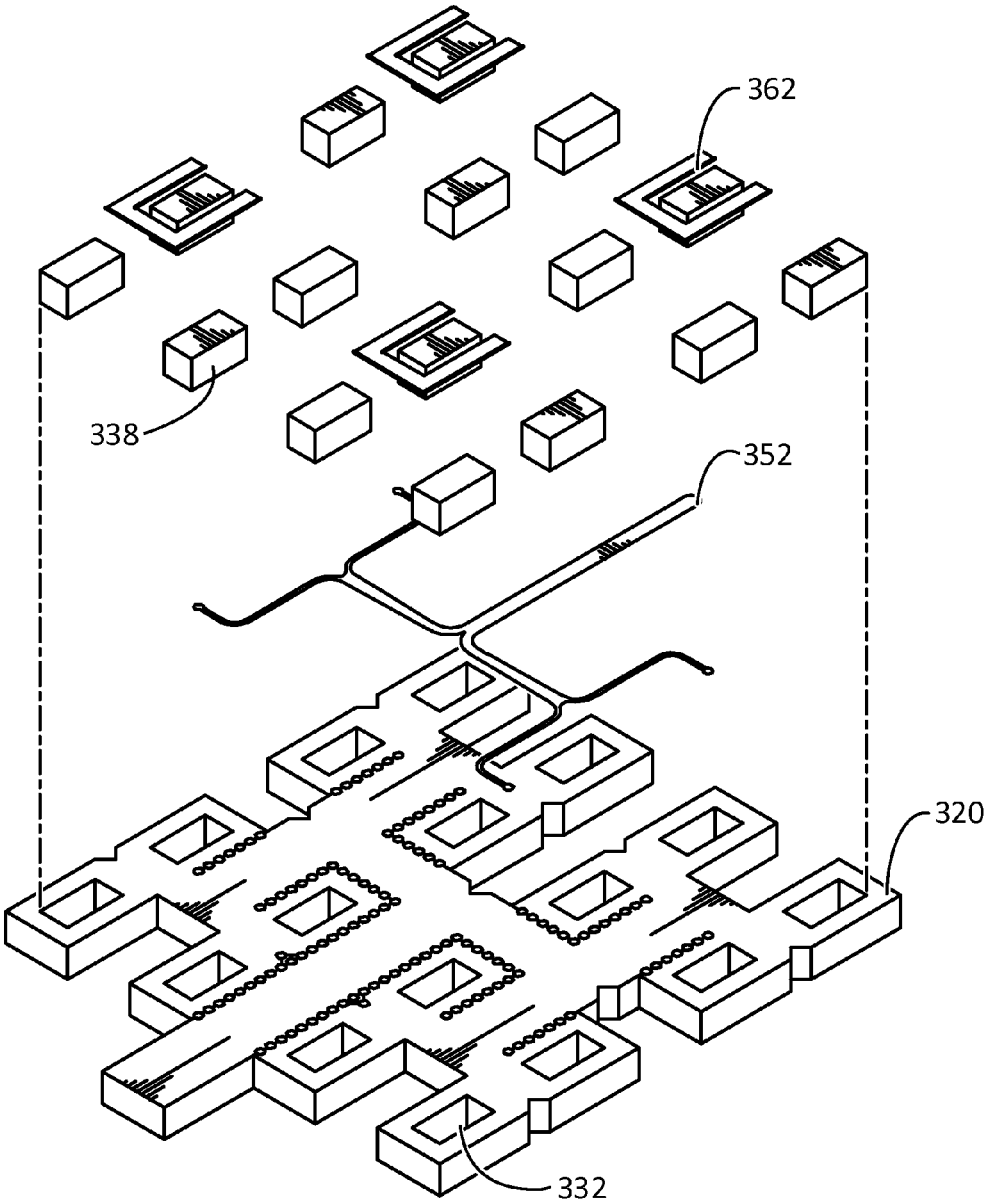
FIG. 3 provides an alternative illustration of selected feature as illustrated in FIG. 1, in accordance with embodiments of the present invention.

FIG. 3 provides an alternative illustration of selected features as illustrated in FIG. 1, in which a branched SIW structure 320, coupling aperture 332, waveguide antenna 338, branched conductive trace 352 of a transmission line, and further antenna 362 are illustrated each as intact features arranged relative to each other in three dimensions and without explicitly showing the various PCB layers. Not illustrated are the ground planes disposed above and/or below the conductive trace 352 in order to complete the transmission line. The upper surface of the SIW 320 may form part of such a ground plane. A conductive sheet may extend from the upper surface of the SIW in order to provide more of the ground plane of the transmission line.

Figure 4:
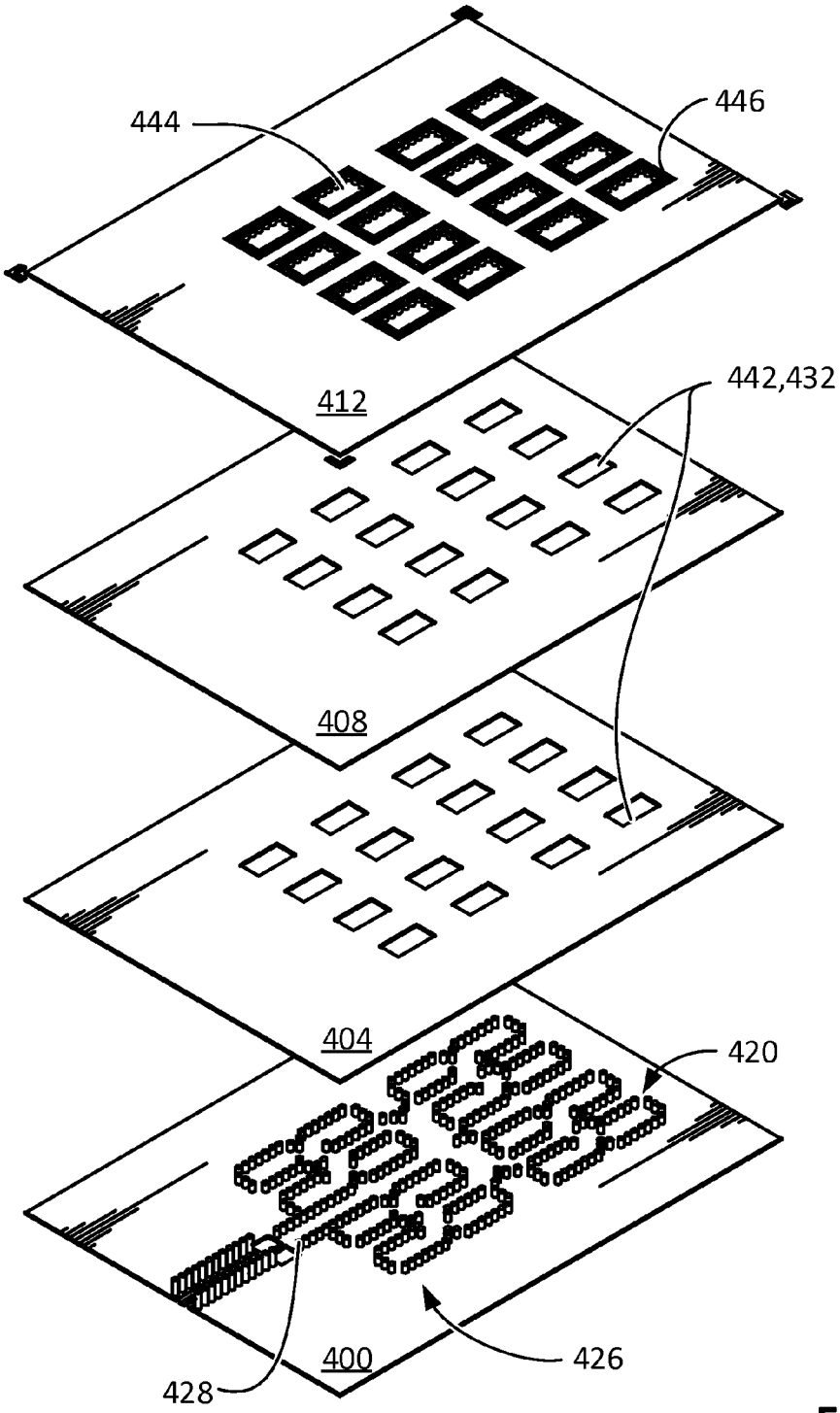
FIG. 4 illustrates an exploded schematic view of a PCB comprising a first functional portion of the PCB, in accordance with embodiments of the present invention.

FIG. 4 illustrates an exploded schematic view of a PCB comprising a first functional portion of the PCB, including the SIW and waveguide antennas coupled thereto. In some embodiments, the first functional portion of the PCB may be provided on its own, in absence of the second functional portion of the PCB. In other embodiments, the illustrated first functional portion may be combined with the second functional portion, including appropriate removal of conductive PCB material to accommodate same. As illustrated, a first conductive layer 400 and a second conductive layer 404 are configured to contain a SIW 420 by provision of a plurality of vias 426 forming a via fence. The SIW, which is illustrated as a branched structure, thereby includes first and second conductive boundaries formed by portions of the first and second conductive layers, respectively, the conductive boundaries lying between opposite sides of the via fence. The via fence may comprise blind vias for example passing only between the first and second conductive layers. Additionally or alternatively, the via fence may comprise through vias. In some embodiments, the through vias may also form part of the boundaries of the waveguide antennas 444.

FIG. 4 further illustrates arrays of first coupling apertures 432 and second coupling apertures 442 formed in the second conductive layer 404 and the third conductive layer 408, respectively. The coupling apertures are arranged in a two-dimensional grid, such that the first coupling apertures 432 are aligned with the second coupling apertures 442 in a first direction which is perpendicular to the plane of the grid. The coupling apertures are further aligned, in the first direction, with a corresponding grid of terminal locations of the SIW, and further with a corresponding grid of waveguide antennas 444. The coupling apertures thereby facilitate coupling of electromagnetic signal between the SIW and the waveguide antennas. The waveguide antennas 444 are provided by forming (for example etching) an array of non-conductive apertures 448 in the fourth conductive layer 412 at locations aligned with the coupling apertures, and surrounding the apertures 448 with vias 446, such as blind vias extending between the third and fourth conductive layers. The apertures of the waveguide antennas 444 may either be about the same size as the coupling apertures, or alternatively larger than the coupling apertures. Providing apertures of the waveguide antennas which are larger than the coupling apertures may correspond to flaring of the waveguide antennas to create a flared horn antenna. In addition, in one embodiment, the second coupling apertures 442 may be larger than the first coupling apertures 432, thereby further providing such flaring.

It is noted that, in FIG. 4, the various conductive layers of the illustrated portion of the PCB comprise non-conductive features (for example removed via etching) only insofar as is required to provide the coupling apertures and interior of the waveguide antennas. As such, the ground planes on the various PCB layers extend laterally beyond the SIW and waveguide antennas. This configuration may improve operational features such as antenna isolation, as well as simplify PCB fabrication for example due to the reduced amount of etching required. The practice of leaving significant areas of ground plane extending outward from features such as the SIW conductive boundaries may also be used in other embodiments, for example as illustrated in FIG. 1.

Figure 5:
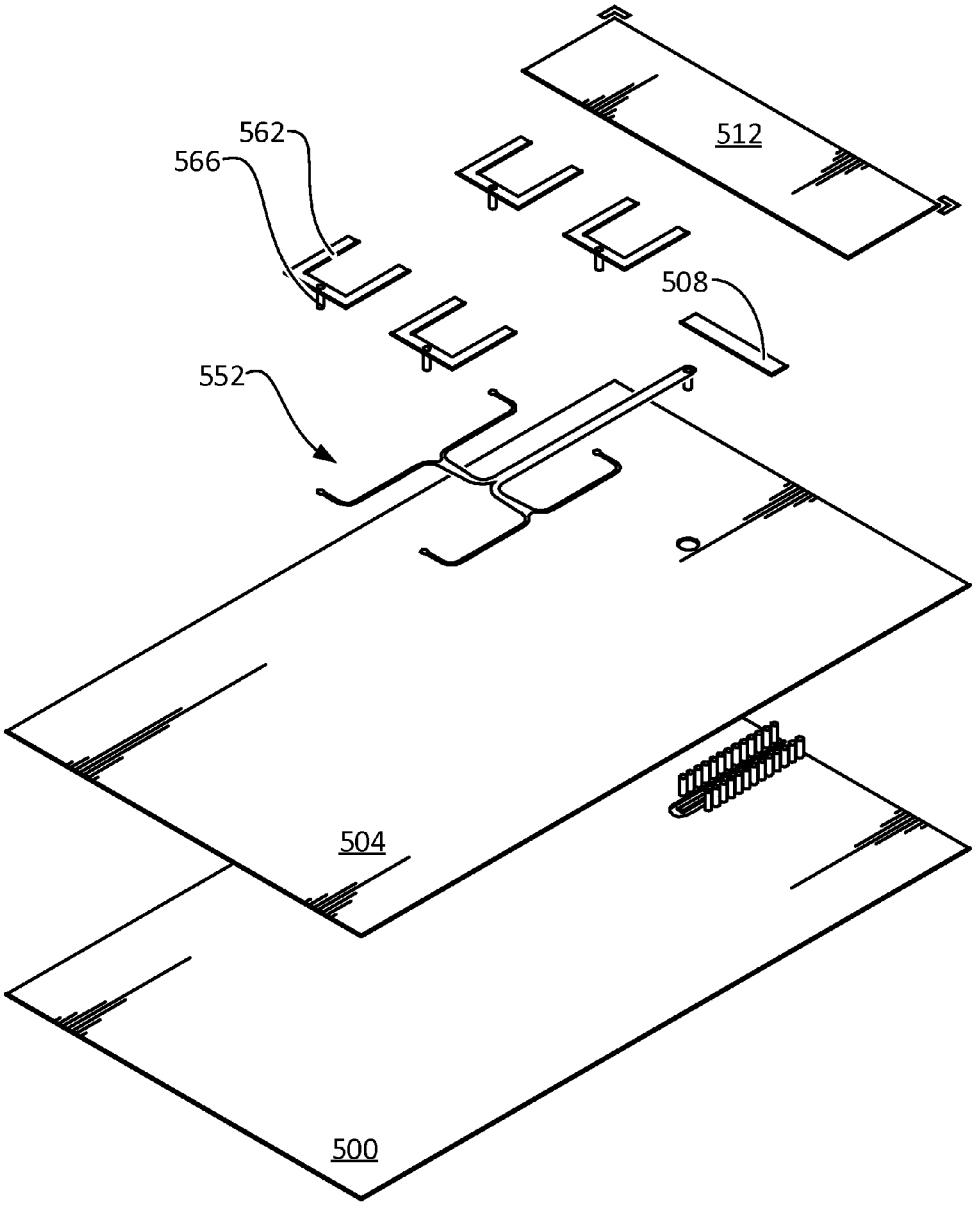
FIG. 5 illustrates an exploded schematic view of a PCB comprising a second functional portion of the PCB, in accordance with embodiments of the present invention.

FIG. 5 illustrates an exploded schematic view of a PCB comprising a second functional portion of the PCB, including the transmission line and antennas coupled thereto. In some embodiments, the second functional portion of the PCB may be provided on its own, in absence of the first functional portion of the PCB. In other embodiments, the illustrated second functional portion may be combined with the first functional portion. As illustrated, a majority of a first conductive layer 500 and a second conductive layer 504 are covered with conductive material, for example to form a pair of ground planes. The first conductive layer may be omitted in various embodiments. A third conductive layer 508 is provided which includes a conductive trace 552 which, together with at least the conductive material of the second conductive layer 504 forms a transmission line such as a microstrip, stripline, or ground-plane backed coplanar waveguide. Conductive portions disposed on a fourth conductive layer 512 may also be provided for forming parts of the transmission line, for example in the case of a stripline. The transmission line comprises a plurality of branches which are routed so as to couple with a grid array of vias 566 which in turn connect to a grid array of patch antennas 562 formed on the fourth conductive layer 512.

Figure 6:
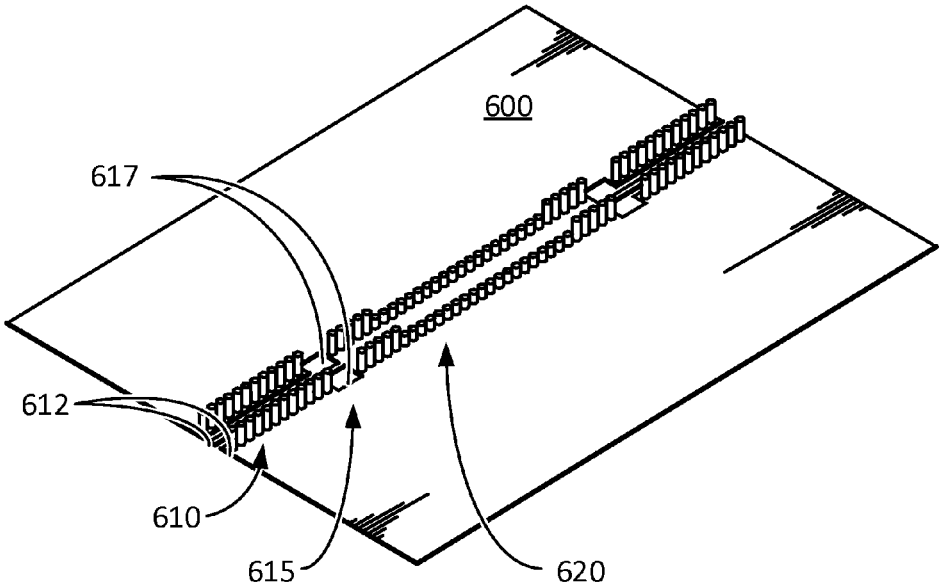
FIG. 6 illustrates a transition from a coplanar Waveguide (CPWG) structure to a SIW structure, in accordance with embodiments of the present invention.

FIG. 6 illustrates of a transition of a Coplanar Waveguide (CPWG) structure to a SIW structure transition. The Coplanar Waveguide structure 610 is disposed on a first conductive layer 600 of the PCB and operatively coupled to a SIW structure 620 through an impedance matching structure 615 disposed between a port of the CPWG structure and a corresponding port of the SIW structure. This structure may be used for various purposes, such as for operatively coupling to the branched SIW structure and associated waveguide antennas as described elsewhere herein, or for other purposes not specifically disclosed herein, such as for providing a general interface between a CPWG and a SIW. The impedance matching structure 615 is at least partially disposed on the first conductive layer 600. A via fence, which may include through vias extending from the first conductive layer 600 to at least a fourth conductive layer is also illustrated, which provides isolation of the CPWG structure 610 and of part of the SIW structure 620. The CPWG structure includes a relatively narrow conductive trace bordered on both sides by gaps 612. The impedance matching structure 615 comprises a pair of non-conductive regions 617 on either side of the conductive trace, which are wider than the gaps 612. The width of the non-conductive regions 617 may be varied to provide a desired impedance matching behaviour. In some embodiments, and as illustrated, a gap in the via fence is provided on either side of the impedance matching structure 615.

Figure 7:
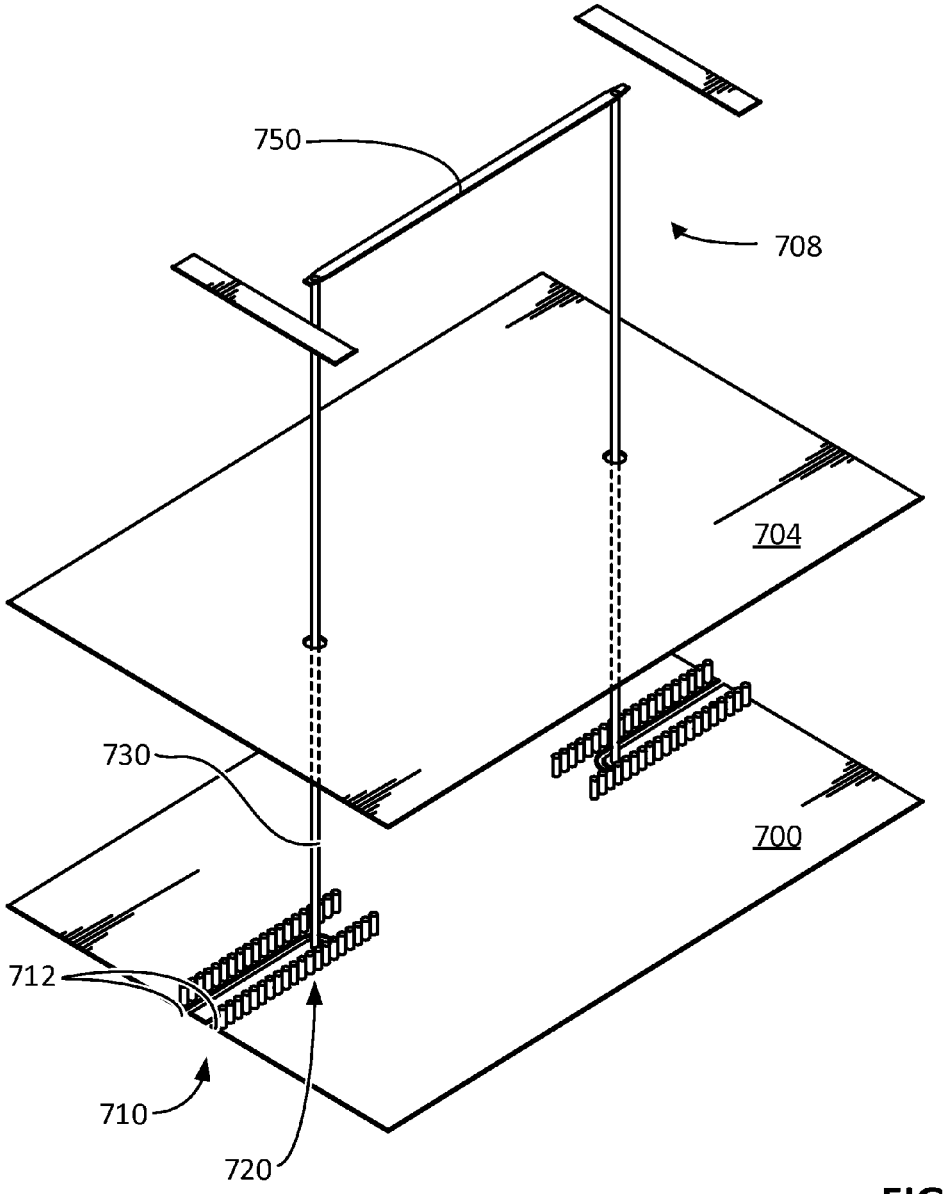
FIG. 7 illustrates a transition from a coplanar Waveguide (CPWG) structure to a transmission line structure, in accordance with embodiments of the present invention.

FIG. 7 illustrates a transition of a Coplanar Waveguide (CPWG) structure to a transmission line structure transition. The Coplanar Waveguide structure 710 is disposed on a first conductive layer 700 of a PCB and operatively coupled to a conductive trace structure 750 of a transmission line on a different conductive layer using a via 730. Alternatively, the CPWG structure may be disposed on a different conductive layer of the PCB, such as a layer above the transmission line structure. This structure may be used for various purposes, such as for operatively coupling to the branched transmission line structure and associated antennas as described elsewhere herein, or for other purposes not specifically disclosed herein, such as for providing a general interface between a CPWG and a transmission line such as a microstrip or stripline. The via 730 connects the conductive trace structure of the transmission line with a port of the CPWG structure. As illustrated, the via passes through an aperture in a second conductive layer 704 located between the first conductive layer 700 and a third conductive layer 708 of the conductive trace 750. The CPWG structure includes a relatively narrow conductive trace bordered on both sides by gaps 712. A via fence 720, which may include through vias extending from the first conductive layer 700 to at least a fourth conductive layer is also illustrated, which provides isolation of the CPWG structure 710.

PCB Manufacture

Embodiments of the present invention relate to a method of manufacturing a PCB comprising at least one signal transmission structure for coupling to at least one antenna or antenna array. The method generally comprises forming traces on multiple conductive layers of the PCB as well as vias, such as through vias, blind vias and optionally buried vias, connecting two or more conductive layers. The pattern of traces and vias is configured so as to provide for the PCB as described elsewhere herein.

Figure 8A:
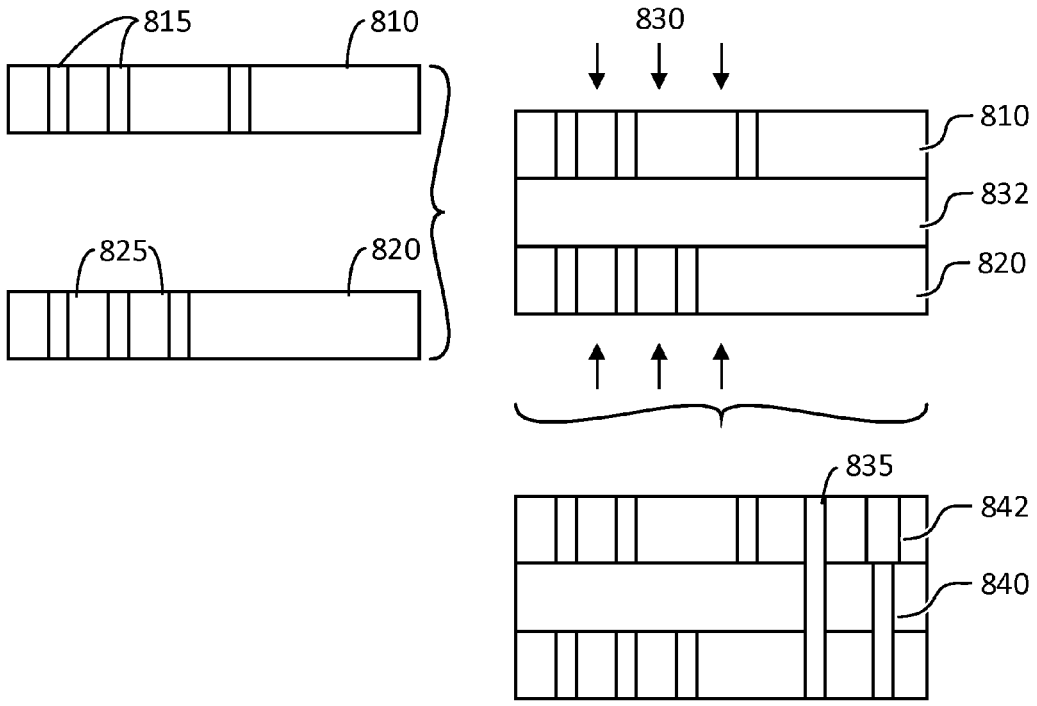
FIG. 8A illustrates a sequence of layer fabrication for manufacturing a PCB in accordance with embodiments of the present invention.
Figure 8B:
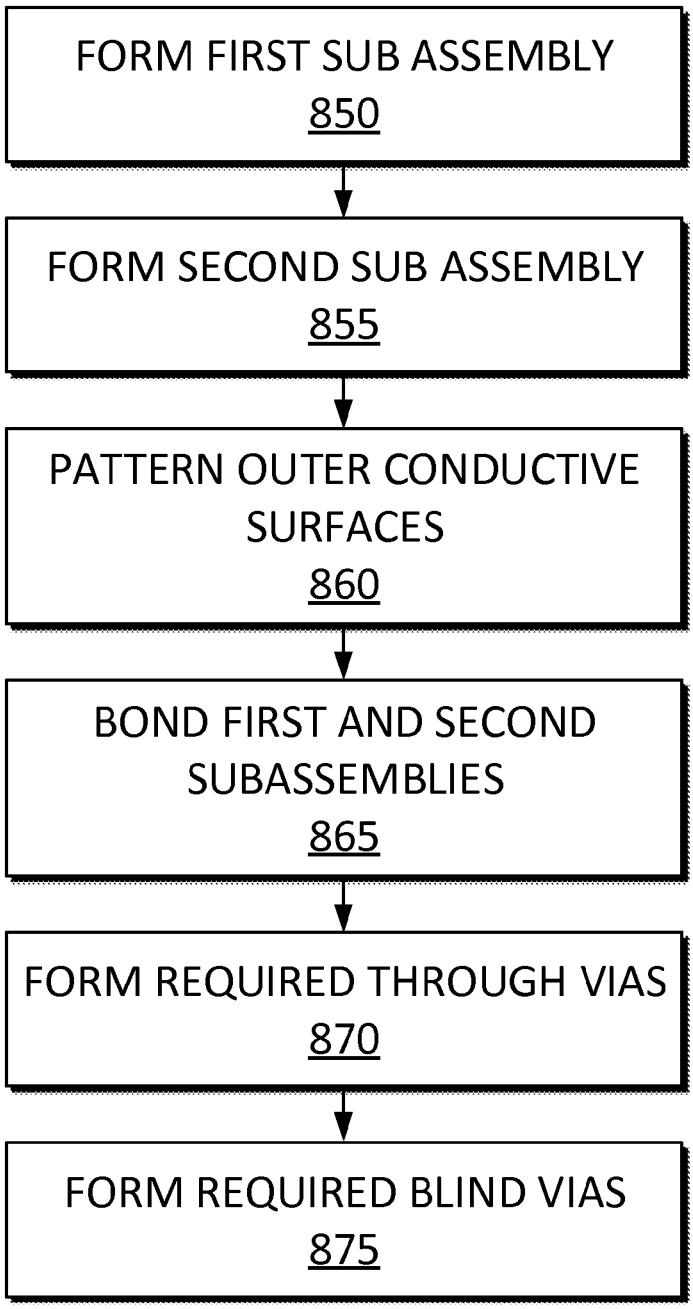
FIG. 8B illustrates a method for manufacturing a PCB in accordance with embodiments of the present invention.

In various embodiments, the method of manufacturing the PCB is further characterized as follows. As before, the PCB comprises first, second, third and fourth patterned conductive layers, wherein the second conductive layer lies between the first and third conductive layers, and the third conductive layer lies between the second and fourth conductive layers. The PCB further comprises a first insulating layer between the first and second conductive layers, a second insulating layer between the second and third conductive layers, and a third insulating layer between the third and fourth conductive layers. Thus, the PCB may be a four (or more) layer PCB. Having reference now to FIGS. 8A and 8B, the method comprises forming 850 a first sub-assembly 810 comprising the first and second conductive layers separated by the first insulating layer, and forming 855 a second sub-assembly 820 comprising the third and fourth conductive layers separated by the third insulating layer. The outer conductive surfaces of the first and second sub-assemblies are patterned 860 appropriately and through vias 815, 825 are created in each of the first and second sub-assemblies, also in an appropriate pattern. Subsequently, the first and second sub-assemblies are bonded 865 together 830 via bonding layer 832 such that the second insulating layer is disposed between the two sub-assemblies. The through vias which were previously created in each of the first and second sub-assemblies thus are transformed into blind vias or possibly buried vias of the assembled PCB product. Subsequently, through vias 835 may be formed 870 in an appropriate pattern in the assembled product, the through vias passing from the first conductive layer to the fourth conductive layer. Vias may be formed using standard drilling and electroplating techniques. In addition, blind vias 840 may be formed 875 in an appropriate pattern in the assembled product, the blind vias passing from the first conductive layer to the third conductive layer or from the fourth conductive layer to the second conductive layer. Blind vias 840 may be formed by first creating a through via and then removing a portion 842 thereof using back drilling. Alternatively, it may be possible to form blind vias using peck drilling or another technique.

For definiteness, and in relation to the above, a method for forming a PCB in some embodiments comprises forming a first sub-assembly comprising a first conductive layer and a second conductive layer separated by a first dielectric layer. The first sub-assembly has a Substrate Integrated Waveguide (SIW) structure having a first conductive boundary disposed within the first conductive layer, a second conductive boundary disposed within the second conductive layer, a plurality of first vias coupling the first conductive boundary to the second conductive boundary, and at least one aperture formed in the second conductive boundary of the SIW structure. Blind vias of the PCB passing only between the first conductive layer and the second conductive layer are formed in the first sub-assembly while separate from the second sub-assembly. The method further comprises forming a second sub-assembly comprising further conductive layers separated by a further dielectric layer. At least one waveguide antenna is disposed at least partially within the further conductive layers. The further conductive layers include a third conductive layer and a fourth conductive layer. The third conductive layer includes a conductive trace of a transmission line. The fourth conductive layer includes at least one further antenna disposed at least partially within the fourth conductive layer and operatively coupled to the transmission structure through a further via. Further blind vias of the PCB passing only between the third conductive layer and the fourth conductive layer are formed in the second sub-assembly while separate from the first sub-assembly. The method further comprises bonding the first sub-assembly to the second sub-assembly to form the PCB, the first sub-assembly separated from the second sub-assembly by a dielectric bonding layer disposed between the second conductive layer and the third conductive layer. The first sub-assembly and the second sub-assembly disposed relatively such that: at least a portion of the conductive trace is aligned overtop of the second conductive boundary of the SIW structure thereby facilitating operation of the transmission line; the conductive trace routed around the at least one aperture; and the at least one aperture is aligned with the at least one waveguide antenna. The method further comprises subsequently forming in the PCB one or more of: through vias passing from the first conductive layer to the fourth conductive layer; blind vias passing from the first conductive layer to the third conductive layer; and blind vias passing from the second conductive layer to the fourth conductive layer.

In more detail, at least some of the vias forming the boundaries of the waveguide antennas, as well as vias coupling the conductor of the transmission line to the further antennas, may be blind vias of the assembled PCB, which were formed as through vias of the second sub-assembly. In addition, at least some of the vias forming the via fence boundary of the SIW may be blind vias of the assembled PCB, which were formed as through vias of the first sub-assembly.

Through vias, formed in the PCB after bonding of the two sub-assemblies, may include via fence structures surrounding and isolating portions of CPWG structures operatively coupled to the SIW and transmission line. Through vias may also include vias having a first portion operating as part of the via fence boundary of the SIW and a second portion operating as part of a boundary of a waveguide antenna. Such through vias may be provided where possible and may further serve as a fence which at least partially isolates and/or directs electromagnetic energy passing between the SIW coupling apertures and the associated waveguide antennas aligned vertically therewith. When further layers are added outside of the two bonded sub-assemblies, the through vias may be converted into blind or buried vias.

Blind (or buried) vias may also be formed in the PCB after bonding of the two sub-assemblies by creating and then subsequently back-drilling a through via formed in the two bonded sub-assemblies. Such a process may be used where it is desired to have a blind (or buried) via which passes between the first and second sub-assemblies, but not through all four conductive layers thereof. An example of such a via is the input transition via connecting the center conductor of a CPWG located on the first PCB layer to the conductor of the transmission line located on the third PCB layer.

Bonding of the two sub-assemblies may comprise interposing one or more layers of dielectric material between the sub-assemblies and bonding the outer conductive layers of each sub-assembly to the interposed layers of dielectric material, as would be readily understood by a worker skilled in the art of multilayer PCB manufacture.

In some embodiments, the thickness of dielectric material interposed between the two sub-assemblies, or equivalently between the second and third layers of the assembled PCB as described elsewhere herein, may be selected to be substantially thin, for example a thickness of 4 mil or 8 mil may be used. This may be preferable so as to dispose the waveguide antennas adequately closely to their corresponding coupling apertures so as to mitigate potential signal leakage. The thickness of adjacent layers of dielectric material may be substantially thicker than 4 mil or 8 mil. In various embodiments, the thinnest feasible layer of dielectric material is used, where feasibility is based on factors such as PCB manufacturing capabilities within specified quality tolerances, potential for grounding of traces, and required spacing between transmission line traces on the third layer and transmission line ground plane features on the second layer.

In an example embodiment, the first insulating layer between the first and second conductive layers may have a thickness of between about 20 mil and 40 mil, for example by using a dielectric such as Rogers™ LoPro™ Series R04350 laminate at 30 mil. The second insulating layer between the second and third conductive layers may have a thickness of between about 4 mil and 12 mil, for example by using a dielectric such as Rogers™ LoPro™ Series R04450B laminate at 8 mil. The third insulating layer between the third and fourth conductive layers may have a thickness of between about 20 mil and 40 mil, for example by using a dielectric such as Rogers™ LoPro™ Series R04350 laminate at 20 mil.

Simulation and Measurement

Figure 9:
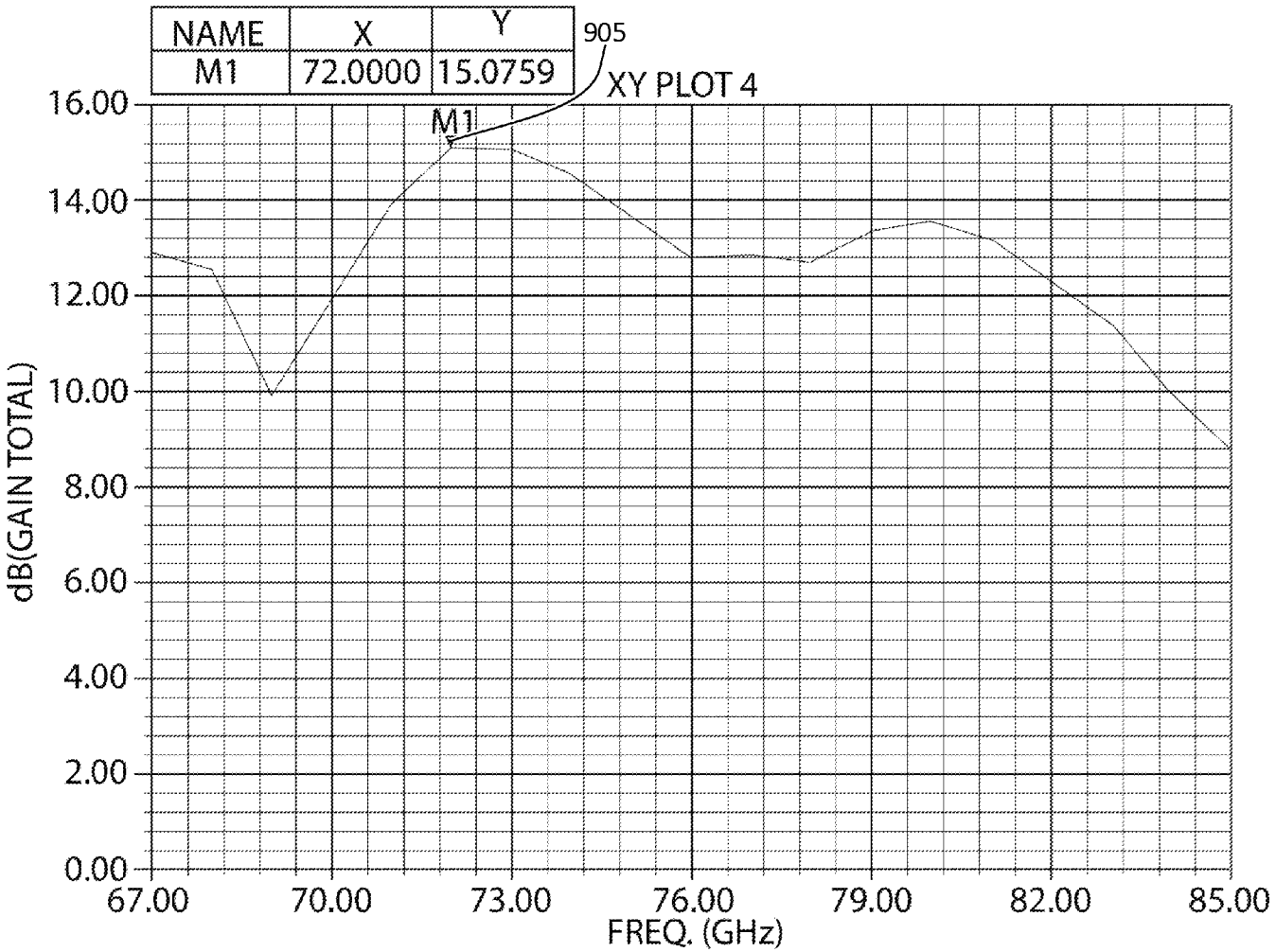
FIG. 9 illustrates simulation array gain results in relation to an example embodiment of the present invention.

FIG. 9 graphically illustrates simulation results in relation to an example embodiment of the present invention. The graph illustrates simulated antenna gain as a function of frequency in an E-band range for a 4×4 array of waveguide antennas for example as illustrated in FIG. 1. A peak gain 905 of about 15 dB is shown at about 72 GHz. A maximum gain of about 15 dBi from about 1.44 square centimetres is therefore achieved.

Figure 10:
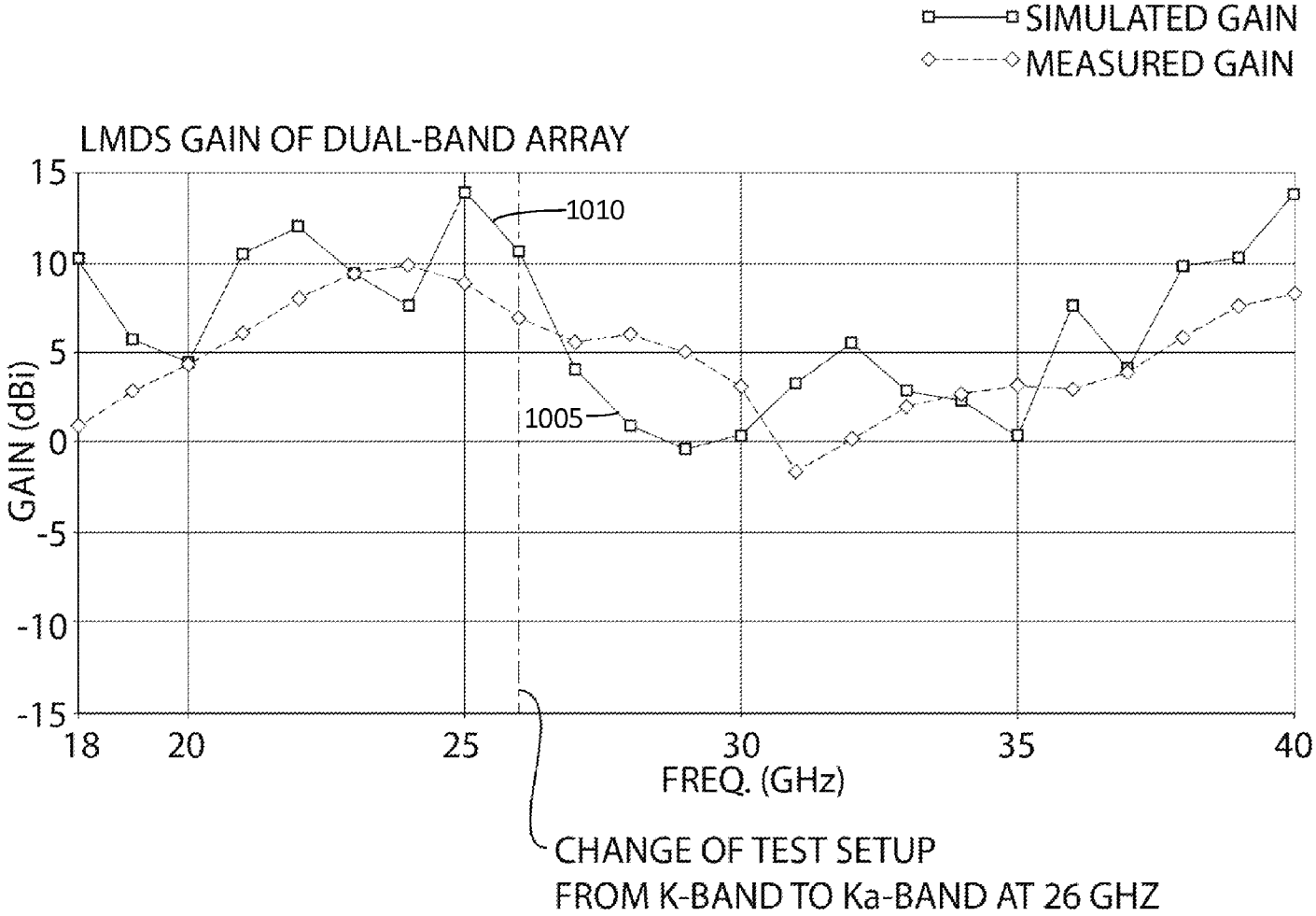
FIG. 10 illustrates simulation and measurement array gain results in relation to another example embodiment of the present invention.

FIG. 10 graphically illustrates simulation and measurement results in relation to an example embodiment of the present invention. The graph illustrates simulated 1005 and measured 1010 antenna gain as a function of frequency in an LMDS band for a 2×2 array of patch antennas for example as also illustrated in FIG. 1.

Additional Details of Antenna Structure and Feed Network

The use of a multilayer PCB-implemented waveguide and multi-conductor transmission line structures, such as striplines, may provide for compact and cost-effective implementation of the present invention, particularly when antenna elements are also implemented as features of a multilayer PCB. Furthermore, such a PCB implementation may be useful when the antenna array includes elements in a two-dimensional arrangement, such as a planar, rectangular grid pattern or a concentric circular pattern.

The various structures as described herein may be provided as appropriate conductive features of a multilayer Printed Circuit Board (PCB), such as features formed by etching of conductive layers, provision of vias, blind vias and buried vias, or the like. Such PCB implementations may be suitably compact for inclusion in wireless communication equipment, such as mobile communication terminals, handheld devices, wireless routers, mobile base stations, picocells, wireless access points, and the like, as well as being suitable for cost-effective volume production.

In embodiments of the present technology, the antenna array includes at least two different sets of antenna elements, which may be of different sizes, different types and/or operate in different frequency bands. Provided in the associated feed network for the antenna array is a first signal transmission structure, such as a multi-conductor transmission line structure, coupled to antenna elements of the first set, the first signal transmission structure being configured for propagating signals according to a first electromagnetic propagation mode, such as a Transverse Electromagnetic (TEM) mode or a quasi-TEM mode. Also provided in the feed network is a second signal transmission structure, such as a waveguide structure, coupled to antenna elements of the second set, the second signal transmission structure being configured for propagating signals according to a second, different electromagnetic propagation mode such as a Transverse Electric (TE) or Transverse Magnetic (TM) mode. The use of different propagation modes may facilitate or enhance signal isolation for the two signal transmission structures, for example within the structures, at the antenna coupling or feed points, or both.

In various embodiments, one or more antenna elements from the first set may be co-located with corresponding antenna elements of the second set to form one or more combination antenna elements. Antenna elements from the first and second sets may correspond to first and second portions of a combination antenna element, respectively. Accordingly, such combination antenna elements may be viewed as being coupled to both the first signal transmission structure and the second signal transmission structure, for example with the first and second signal transmission structures coupled to the first and second portions of the combination antenna element, respectively. At least in part in order to service the co-located antenna elements, the signal transmission structures may be integrated with each other, for example to share common features as described below.

The use of two signal transmission structures for separately feeding two sets of antenna elements may facilitate a desired impedance matching as well as a desired spacing for the corresponding antenna array. For example, each signal transmission structure may be customized to provide an efficient, impedance-matched feed for its corresponding type of antenna element, rather than attempting to match a single signal transmission structure to two different types of antenna elements.

In various embodiments, one or both of the first and second signal transmission structures may be branching structures, such as symmetric branching structures. For example, in order to provide a transmission line or waveguide which couples multiple antennas of an array antenna to a common signal source or destination such as an amplifier or other RF front-end component, the corresponding signal transmission structure may include at least one branching point, such as a bifurcation point, where the signal transmission structure branches or forks into a plurality of branches to provide multiple paths to and/or from the multiple antennas. The branches may terminate proximate to the points at which they couple to corresponding antenna elements.

Further, in various embodiments, the first and second signal transmission structures may share one or more common features, such as ground plane features. For example, a multi-conductor transmission line structure, such as a microstrip, may be provided overtop of a waveguide structure, such as a SIW, the transmission line structure using a conductive plane of the waveguide structure as its reference or ground plane structure. As such, part or all of the waveguide structure also operates as one conductor of the multi-conductor transmission line structure. That is, one conductor of the multi-conductor transmission line corresponds to a conductive boundary of the waveguide structure. Such arrangements facilitate the interleaving and/or co-existence of the two signal transmission structures. This may facilitate a size reduction in the overall antenna array feed network. Structural portions and/or volumes occupied by the two signal transmission structures may overlap or be shared. Further, in some embodiments the integration of the two signal transmission structures may facilitate the overlapping of signal paths, so that the two signal transmission structures may be routed between common points while occupying a limited, common volume.

It is noted that various embodiments provide for an alternative manner of feeding a dual-band antenna array. Namely, rather than using a single wideband feed network to couple to multiple antenna elements operating at different frequencies, two interleaved and relatively narrowband feed networks may be provided.

In various embodiments, the interleaving of the two signal line transmission structures facilitates providing an antenna feed network with a desired spacing between feed points or ports. Moreover, the interleaved structure may allow for narrower port spacing than some other non-interleaved approaches. This can be beneficial for servicing antenna arrays with a specific inter-element spacing requirement, for example as in an array of mmW antenna elements spaced apart by half of an operating wavelength. One aspect which may enable the desired spacing between feed points is the reduced volume occupied by the interleaved transmission line structure when compared with two separate structures. Another aspect may be the simplified arrangement due to the reduced requirement for separate transmission line to avoid each other. Such considerations may be particularly prominent when the signal line transmission structures are provided as layers within a PCB, due to the particular layout constraints thereof.

Some embodiments of the present invention comprise a waveguide structure which is routed to relatively higher-frequency antenna elements with smaller inter-element spacing and a multi-conductor transmission line structure which is routed to relatively lower-frequency antenna elements with larger inter-element spacing. Other embodiments of the present invention comprise a multi-conductor transmission line structure which is routed to the relatively higher-frequency antenna elements with smaller inter-element spacing and a waveguide structure which is routed to the relatively lower-frequency antenna elements with larger inter-element spacing. In either case, the two transmission line structures each have different numbers of (potentially symmetric) branches in order to feed different numbers of antenna elements disposed in the array with different inter-element spacing or pitch. As such, a quantity of branches of one transmission line structure may be less than a quantity of branches of the other transmission line structure.

Various embodiments of the present invention provide for a pair of interleaved signal line transmission structures, each of which includes a different number of ports spatially disposed at different pitches or inter-port spacing in an array. Further, in some embodiments, some of the ports of a first one of the signal line transmission structures are co-located with some of the ports of a second one of the signal line transmission structures. Thus, some antenna elements may be fed in a dual mode manner whereas other antenna elements are fed in a single mode manner.

In various embodiments, the first and second transmission line structures are substantially symmetric. For example, the path lengths from a common feed port to each antenna connection port of a provided branching transmission structure may be substantially equal. Further, the path shape from the common feed port to each antenna connection port of the provided branching transmission structure may be substantially the same. Yet further, the branching pattern and number of branchings along each path may be substantially the same. In some embodiments, one or more of the above symmetries may facilitate operating each of the antenna elements connected to the transmission line structure with substantially equal phase, for example due to substantially equal path lengths, and with substantially even power distribution between branches. It would be readily understood by a worker skilled in the art that the above use of the word substantially with respect to the terms indicative of symmetry, equality and similarity provides for a level of variation in the symmetry, equality and similarity, respectively. For example the word substantially can provide for a variation of about 5%. However, it is understood that depending on the specific requirements of the multi-mode feed network, in some instances a variation of 5% of similarity, equality or symmetry may result in an undesired level of phase error, while in other instances a variation of 5% of similarity, equality or symmetry may be acceptable. Accordingly, these further levels of variation are to be considered within the scope of the definition of the word substantially.

The feed network as described herein may be used to couple elements of an antenna array to other components of an RF front-end, such as power amplifiers, low-noise amplifiers, or the like. Such elements may be coupled to the feed network at a root port of the branched transmission line structure. In some embodiments, each transmission structure is separated and coupled to different signal processing and/or signal generation electronics.

Some embodiments of the present invention provide for a combination antenna element having a first antenna element, for example a waveguide antenna element, and a second antenna element, for example a Microstrip Patch Antenna (MPA) element. The first antenna element is configured for operative coupling to a first antenna feed and is operative in a first frequency band, for example an E-band. Likewise, the second antenna element is configured for operative coupling to a second antenna feed and is operative in a second frequency band, such as a LMDS, which may be different from the first frequency band.

Further, in various embodiments, the second antenna element includes a perimeter, such as an open perimeter, defining an interior region, such that at least a portion of the first antenna element is positioned in and/or aligned with the interior region. In this sense, alignment with the interior region may be further described, in various embodiments, by the first and second antenna elements being situated substantially within two different parallel planes, the elements aligned such that an orthogonal projection of the perimeter of the first antenna element, from the first plane to the second plane, falls within the interior region. Alternatively, the interior region may be further described, in various embodiments, by defining a pair of opposing faces of the second antenna element. The interior region corresponds to a cavity which extends from one of the opposing faces to the other and hence communicates with both opposing faces. The cavity may also communicate with a further face of the second antenna element which connects the pair of opposing faces, thereby forming the open perimeter. Further, at least a portion of the first antenna element is aligned with the cavity along a direction which is perpendicular to the pair of opposing faces.

Some embodiments of the present invention provide for a combination antenna element including a waveguide or similar antenna element and a patch antenna element in close proximity. The waveguide antenna element is configured for operative coupling to a first antenna feed, such as a waveguide, and the waveguide antenna element is operative in a first frequency band. Further, the first antenna feed propagates first signals according to a first electromagnetic propagation mode, such as a Transverse Electric (TE) or Transverse Magnetic (TM) mode. The patch antenna element is configured for operative coupling to a second antenna feed, such as a multi-conductor transmission line, and the patch antenna element is operative in a second frequency band which may be different from the first frequency band. Further, the second antenna feed propagates second signals according to a second electromagnetic propagation mode, such as a Transverse Electromagnetic (TEM) mode, which is different from the first electromagnetic propagation mode.

Furthermore, some embodiments of the present invention correspond to a combination of the above embodiments. For example, a combination antenna element according to some embodiments may include a waveguide antenna element coupled to a first antenna feed and a patch antenna element coupled to a second antenna feed, where the first antenna feed and the second antenna feed propagate signals according to different electromagnetic propagation modes. In addition the patch antenna element may include a radiating body which is shaped to have an open perimeter defining an interior region. Such an open perimeter may form the boundary of the interior region and also communicate with an exterior perimeter of the patch antenna element. An example of such a shape is a "C" shape or a crescent shape. In other embodiments, the interior region may be completely enclosed within the radiating body, and the perimeter may correspond to a closed perimeter around the interior region. An example of such a shape is an "O " shape. Furthermore, the waveguide antenna element is positioned in or aligned with the interior region.

In some embodiments, a patch antenna element is provided in conjunction with a waveguide antenna element. However, in other embodiments the types of antenna elements are varied while still exhibiting other features as described herein. For example, in some embodiments a slot antenna, a dielectric resonator antenna (DRA) such as a slot-coupled DRA, a horn antenna, such as a horn antenna integrated into a PCB substrate, or an aperture coupled patch antenna may be used in place of the waveguide antenna. Additionally or alternatively, in some embodiments an aperture coupled patch antenna, capacitive coupled patch antenna, inductive coupled patch antenna, slot antenna, or the like, may be used in place of the microstrip or patch antenna.

Furthermore, some embodiments of the present invention provide for an antenna array including combination antenna elements as described herein. For example, the antenna array may comprise the combination antenna elements interleaved with other types of antenna elements, such as in a two-dimensional grid, to form a co-aperture antenna array. The antenna array may be a sub-array of a larger antenna array.

Further, in some embodiments, the antenna array may include higher-frequency elements interleaved with lower-frequency elements, with the higher-frequency elements more closely spaced and more numerous than the lower-frequency elements. The combination antenna elements may include a higher-frequency element and a lower-frequency element. Thus the combination antenna elements may be provided with an inter-element spacing corresponding to a desired inter-element spacing of the lower-frequency elements, and with one or more higher-frequency elements located between adjacent combination antenna elements. As such, both types of elements are provided for in the array, with appropriate inter-element spacing.

For example, a two-dimensional grid-based dual-band antenna array may be provided in which the desired inter-element spacing of higher-frequency elements is x units, and the desired inter-element spacing of higher-frequency elements is y=kx units, where k is an integer greater than 1. The array may be realized as a rectangular grid with a spacing of x units, such that every $k^{th}$ row and column on the grid includes one of the combination antenna elements, and the intervening locations on the grid includes one of the higher-frequency antenna elements. As such, the inter-element spacing for both frequencies is maintained, with some locations in the grid operative at both frequencies. Notably, the combination antenna elements operate in part at the higher frequency, thereby avoiding gaps in the array of higher-frequency antenna elements at the locations of the combination antenna elements. In various embodiments, the inter-element spacing is about equal to, or at least on the same order, as half of a center operating wavelength of the type of antenna element under consideration, or alternatively a predetermined integer multiple or fraction of the operating wavelength.

In various embodiments, the combination antenna element includes two different types of antenna elements, such as the MPA element and the waveguide aperture antenna element. Patch antennas may be viewed as being equivalent to two slots and the coupling between two closely spaced patches may affect operation. By using different types of antenna elements in close proximity, the issue of coupling between two patch antennas may be mitigated. The waveguide aperture antenna element may exhibit generally low coupling with other antenna elements in close proximity with the sides of the waveguide for example due to the metallic walls of the waveguide.

In some embodiments, for an antenna array application, the use of different antenna element types facilitates a reduced mutual coupling between different array elements. Thus, a MPA element and waveguide aperture antenna element may be utilized in the above illustrated embodiment. Alternatively, various other types of antenna elements may be used, provided that the first and second antenna elements of the combination antenna element are of different types.

In various embodiments, a patch antenna element (MPA) and a waveguide antenna element aligned with a cavity of the patch antenna may be viewed as a combination antenna element. These two elements may be at least partially configured to operate in presence of one another. As such, the two antenna elements may be co-optimized. Co-optimization may be constrained optimization, and generally comprises a co-design of the two antenna elements so as to operate adequately when in close proximity. For example, the location of the feed to the MPA element may be adjusted to achieve desired MPA performance when a waveguide antenna is aligned with, the interior region of the crescent-shaped MPA. Other physical dimensions of the elements can be similarly adjusted for example to optimize the antenna elements each in presence of the other. It is noted that the MPA may be physically larger in surface area than the waveguide antenna, in order to provide for alignment of the waveguide antenna within the interior region of the MPA.

As such, some embodiments of the present invention provide for inclusion of an aperture or waveguide antenna in line with an interior region defined by a patch antenna having a perimeter, such as an open perimeter, the aperture or waveguide antenna being located on a different plane from a radiating body of the patch antenna. This configuration may result in an increased impedance bandwidth of the patch antenna while also facilitating re-use of the interior region of the patch antenna for electromagnetically accessing the aperture or waveguide antenna, for example by conceptually providing a "window" in the patch antenna body which is in line with a radiated field of the waveguide aperture antenna element, thereby substantially inhibiting the MPA from obstructing a major portion of this radiated field. Thus, a three-dimensional structure providing two antennas facing a common plane can be provided.

In various embodiments, optimizing of the waveguide antenna in presence of the MPA comprises tuning the dimensions thereof. For example, width and length of the SIW may be configured in order to provide for a desired operating frequency band. In addition, the location of the slot opening may also be configured in order to affect the operating frequency band. Tuning of the dimensions may be motivated by the presence of the main patch body of the MPA above the waveguide antenna as well as the thickness of the substrate layer overtop of the waveguide slot in various PCB implementations which require additional layers formed overtop of the waveguide slot.

Various embodiments of the present invention comprise antenna elements and antenna arrays as described in this section. The following embodiments are intended to be illustrative rather than limiting.

Figure 11:
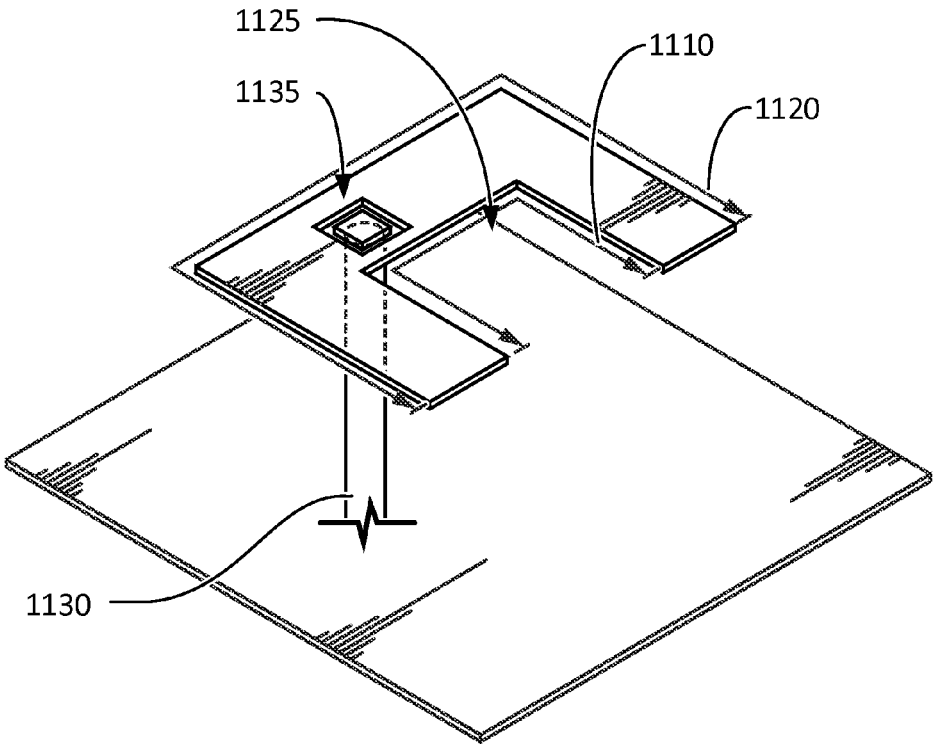
FIG. 11 illustrates a perspective view of a microstrip patch antenna (MPA) element provided in accordance with embodiments of the present invention.

FIG. 11 illustrates a perspective view of a microstrip patch antenna (MPA) element provided in accordance with embodiments of the present invention. The MPA element may correspond to the at least one further antenna disposed at least partially within the fourth conductive layer and operatively coupled to the conductive trace, as specified elsewhere herein. The MPA may be configured to operate in a desired band, for example the LMDS band. In various embodiments, the percentage bandwidth of the antenna is configured at about 20%. In one embodiment, the bandwidth is about 6 GHz, centred at about 28.5 GHz. As illustrated, the MPA includes an inner perimeter 1110 and an outer perimeter 1120, which correspond to two different perimeters which create two relatively close resonances, for example at about 26.5 GHz and 31 GHz. This may facilitate achievement of the desired bandwidth. The inner perimeter 1110 and the outer perimeter 1120 are substantially parallel and communicate with each other to form an open perimeter defining an interior region 1125 adjacent to the inner perimeter.

A via 1130 is illustrated as an antenna feed. The body of the MPA may be provided as a feature in a PCB layer, while the via 1130 extends to couple the MPA to a multi-conductor transmission line located at another layer of the PCB. In some embodiments, a relatively high inductance of the via 1130 is compensated for by a capacitive coupling of the via to the MPA body implemented via a slot 1135 formed between the via and the MPA body in the plane of said MPA body. The location of the via 1130 may be configured and optimized for desired operation of the MPA in presence of other nearby antenna elements, such as the waveguide element described elsewhere herein. As illustrated, the via

1130 is located proximate to a corner of the inner perimeter 1110. The via feed allows for separation of the MPA and the waveguide and may assist in further isolation between the MPA and the waveguide.

The MPA may be combined with a waveguide aperture antenna element to form a combination antenna element. The combination antenna element includes a Microstrip Patch Antenna (MPA) element having a C shape or crescent shape when viewed from above. An open perimeter of the patch has an opening at one side to define the interior region 1125. The interior region is not fully enclosed by the patch in the horizontal plane of the PCB, but rather is open along one face but closed along the other three faces.

The waveguide aperture antenna element is aligned with the interior region 1125 defined by the patch antenna element so that the aperture antenna element appears to be contained within the interior region 1125 in a plan view from above. The waveguide element has an aperture which is at least partially located on a different plane (and hence a different layer of the PCB) than the radiating body of the MPA. When the interior region is defined as extending orthogonally into the PCB, the waveguide aperture antenna element can be said to be positioned in the interior region. Alternatively the waveguide aperture antenna element can be said to be aligned with the interior region of the MPA. In either case, the interior region of the MPA provides a "window" which is in line with a radiated field of the waveguide aperture antenna element, thereby substantially inhibiting the MPA from obstructing a substantial portion of the radiated field of the waveguide aperture antenna.

The waveguide aperture antenna element is fed by a Substrate Integrated Waveguide (SIW) defined by the upper ground plane and the lower ground plane, as well as a plurality of appropriately spaced vias interconnecting the two ground planes, as would be readily understood by a worker skilled in the art.

In one embodiment, the dimensions of the patch antenna include a length of about 4.0 mm, and a width of about 3.0 mm. The dimensions of the aperture antenna include a length of about 1.2 mm, which may be a length of the slot and a width of about 0.6 mm. Such dimensioning may be suitable for operation of the patch antenna element in a frequency range including 28 GHz and operation of the aperture antenna element in a frequency range including 84 GHz, when a dielectric constant Er of about 3.5 is utilized. Thus, the patch element may be suitable for LMDS while the aperture element may be suitable for E-band. Other dimensioning may be used, with a corresponding adjustment to operating frequency and dielectric materials used.

In some embodiments, the via feed location may be selected as a function of patch impedance and the input impedance of the feed. Additionally or alternatively, the via feed location may be selected such that it is as close to the line of patch's symmetry as possible to result in a desired radiation pattern. The operation bandwidth of the patch may be viewed as a function of vertical separation of PCB layer; in general the higher the dielectric thickness the higher the operating bandwidth. However increased substrate thickness may result in a substrate mode during antenna operation which may result in lowered radiation efficiency.

Figure 12:
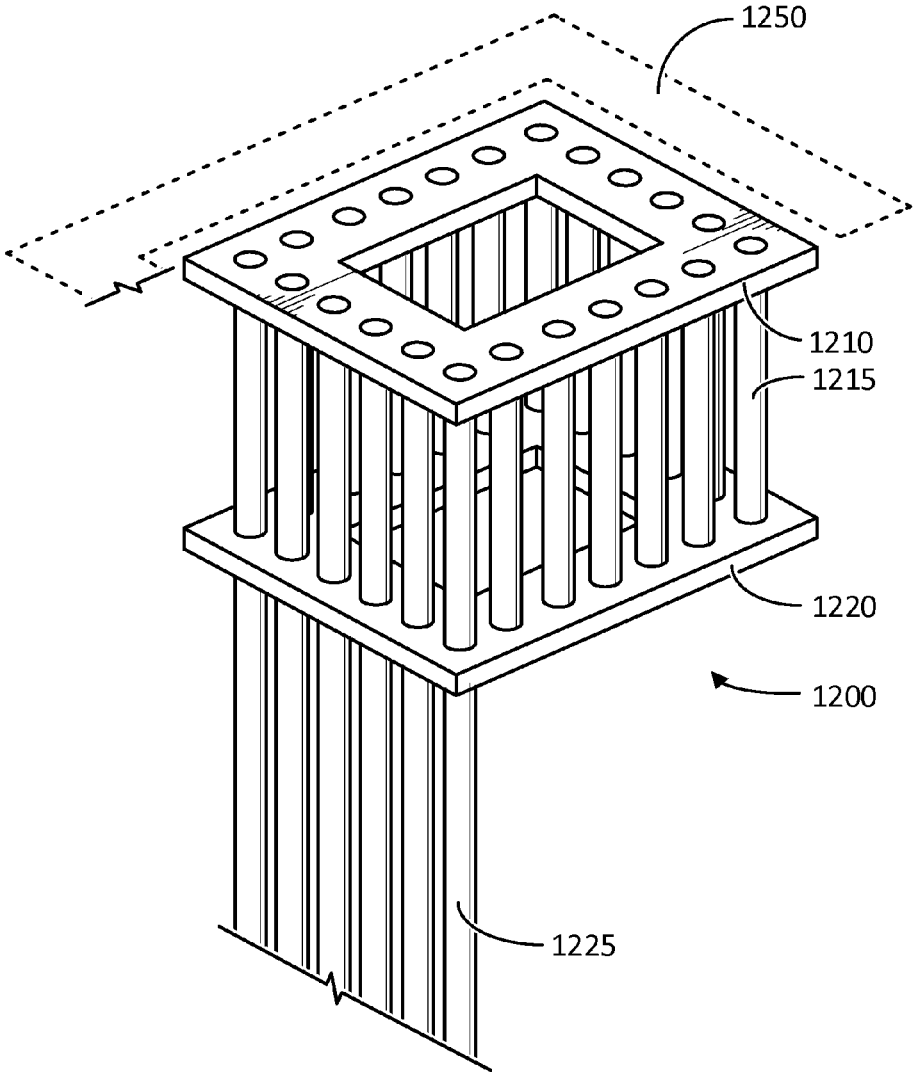
FIG. 12 illustrates a perspective view of a waveguide antenna element provided in accordance with embodiments of the present invention.

FIG. 12 illustrates a perspective view of a waveguide antenna element 1200 provided in accordance with embodiments of the present invention, for example as provided within the interior region of a corresponding patch 1250 of an MPA, which is illustrated for reference, or as provided without being placed inside the interior region of a corresponding MPA. The waveguide antenna element 1200 includes a first closed conductive trace 1210 formed in a first PCB conductive layer which also potentially includes the patch 1250 of the MPA, and a second closed conductive trace 1220 formed in another PCB conductive layer. A plurality of vias 1215 connect the closed conductive traces 1210 and 1220. The closed conductive traces and the plurality of vias define a perimeter of a non-conductive region of the waveguide antenna 1200. Optionally, while some of the vias 1215 may terminate at the conductive traces 1210 and 1220, at least some other of the vias 1215 may extend 1225 for example toward a SIW provided in lower layers of the PCB, and may comprise part of the via fence of the SIW.

Figure 13A:
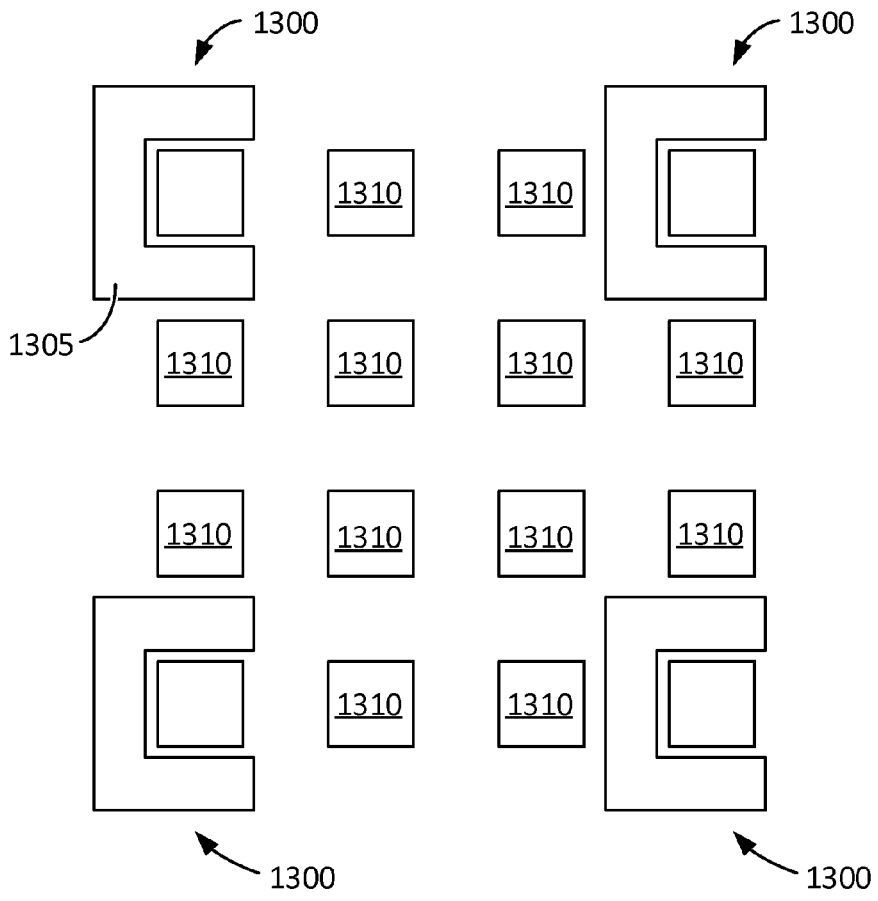
FIG. 13A illustrates a dual-band antenna array provided in accordance with some embodiments of the present invention.

FIG. 13A illustrates an antenna array or sub-array portion thereof, provided in accordance with some embodiments of the present invention. The array comprises combination antenna elements 1300 interleaved with other antenna elements 1310, in accordance with an embodiment of the present invention. As illustrated, every fourth element row-wise and column-wise in the array is a combination antenna element 1300. Put another way, the inter-element spacing between antenna elements 1310 is x units on centre, while the inter-element spacing between combination antenna elements 1300 is 3x units on centre. In one embodiment, in association with the LMDS and E-Band operation, the inter-element spacing between antenna elements 1310 is about 2.5 mm, and the inter-element spacing between combination antenna elements 1300 is about 7.5 mm. Notably, the "C"-shaped component 1305 of the combination antenna elements 1300 is compactly configured such that it fits within the space between adjacent antenna elements 1310. As such, the width across branches of the "C," that is the widths of rectangular regions forming the component 1305, is restricted to be less than about 1.3 mm in the presently illustrated embodiment. In some embodiments, the widths of these regions of the component 1305 is about 1 mm, which corresponds to a 2 mm by 2 mm square interior region for accommodating therein the square or rectangular waveguide antennas having edge sizes less than or equal to 1.2 mm. In some embodiments, the waveguide antennas are rectangular with edge sizes of 0.6 mm and 1.2 mm.

In some embodiments, for an antenna array application, the use of different antenna element types facilitates a reduced mutual coupling between different array elements. Thus, a MPA element and waveguide aperture antenna element may be utilized in the above illustrated embodiment. Alternatively, various other types of antenna elements may be used, provided that the first and second antenna elements of the combination antenna element are of different types.

In various embodiments, a branched transmission line structure may be used to feed the various elements of the antenna array. For example, a branched waveguide structure may be routed to each of the waveguide aperture antenna elements of the array, while a branched stripline structure embedded within the branched waveguide structure may be routed to each of the MPA elements of the array. Each of the antenna elements may be disposed at a terminus of a corresponding branch of the transmission line structure.

Figure 13B:
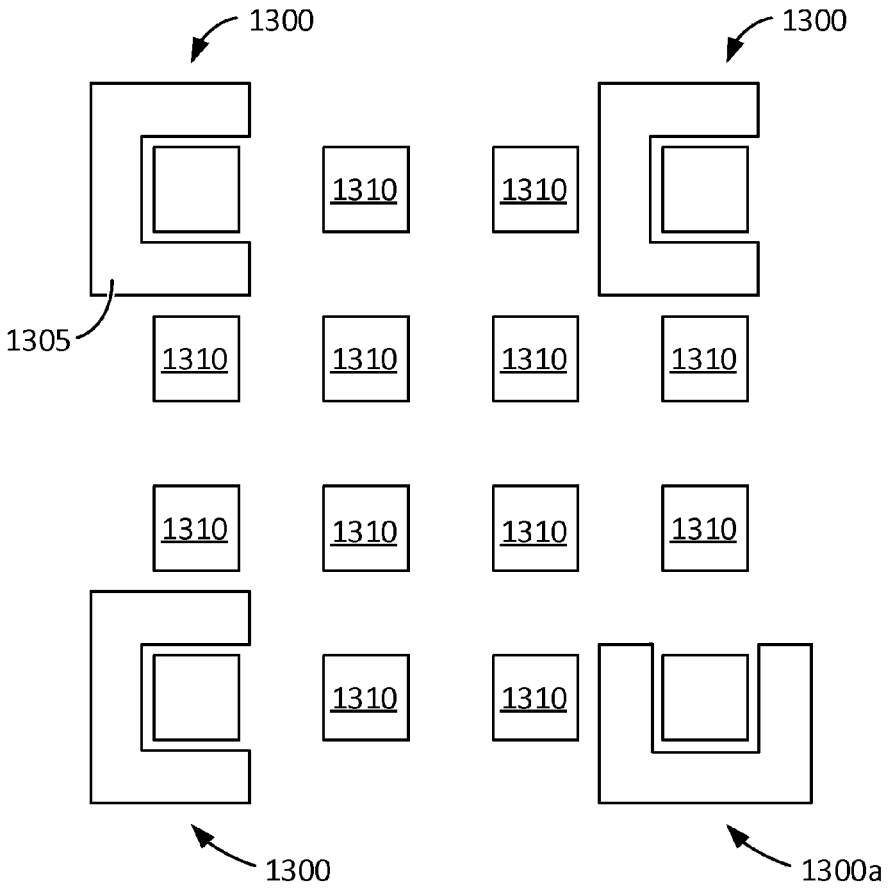
FIG. 13B illustrates a dual-band antenna array provided in accordance with other embodiments of the present invention.

FIG. 13B illustrates a dual-band antenna array or sub-array portion thereof provided in accordance with an embodiment of the present invention. The antenna array or sub-array portion comprises combination antenna elements 1300 interleaved with other antenna elements 1310. In this embodiment, one of the combination antenna elements 1300*a*, has been rotated relative to the other combination antenna elements 1300. As would be readily understood, plural combination antenna elements may be rotated relative to the other combination antenna elements within the antenna array or sub-array portion. While FIG. 13B illustrates a 90 degree rotation of combination antenna element 1300*a* relative to the other antenna elements 1300, other angles of relative rotation are possible. Furthermore, in embodiments where multiple combination antenna elements are rotated relative to other combination antenna elements, the angle of rotation of a first combination antenna element may be different from the angle of rotation of another combination antenna element.

Communication Equipment

In embodiments of the present invention, there is provided a wireless communication device comprising the PCB implemented antenna and/or signal transmission structure as described elsewhere herein. The wireless communication device may be for example a mobile device, user equipment, cellular phone, computer, or other device.

In embodiments of the present invention, there is provided a base station of a wireless communication system, the base station comprising the PCB implemented antenna and/or signal transmission structure as described elsewhere herein. The base station may be a wireless router or other device which acts as a wireless access point for other devices such as user equipment.

In embodiments of the present invention, there is provided a radar device, such as an automotive radar, comprising the PCB implemented antenna and/or signal transmission structure as described elsewhere herein. The antenna may be used in implementation of the radar device by facilitating transmission and/or reception of radar signals.

Figure 14:
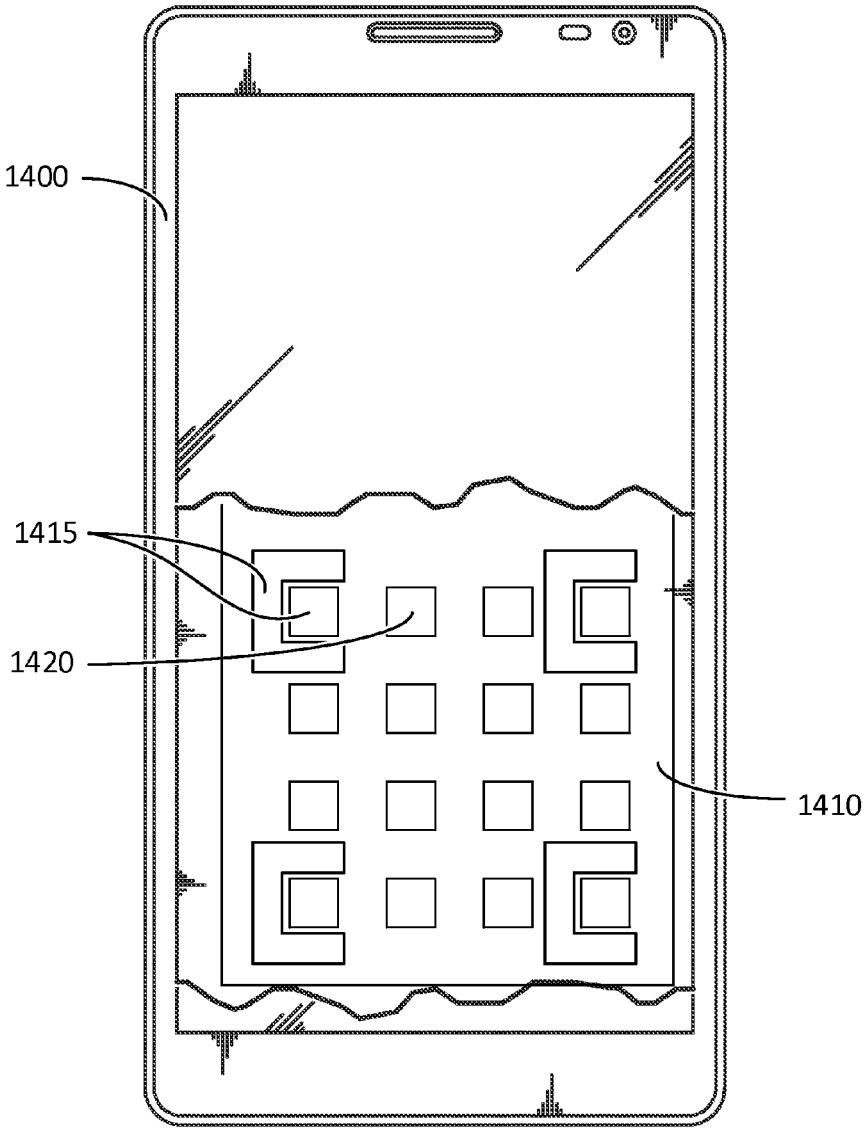
FIG. 14 illustrates a handheld wireless communication device comprising a PCB in accordance with embodiments of the present invention.

FIG. 14 illustrates a handheld wireless communication device 1400 comprising a PCB 1410 comprising antenna elements, transmission line structures and/or SIW structures as described elsewhere herein. By way of non-limiting illustration, the PCB 1410 includes an array of antenna elements which includes combination antenna elements 1415 interleaved with additional antenna elements 1420. The combination antenna elements 1415 may include a crescent-shaped MPA on a PCB surface layer and a waveguide antenna element formed at least partially on a PCB interior layer, the waveguide antenna element being aligned within the interior region formed by the crescent of the MPA. The additional antenna elements 1420 may be waveguide antenna elements formed at least partially on the PCB interior layer. Additional antenna elements 1420 may be similar in structure and character to the waveguide antenna element of the combination antenna element 1415. The handheld wireless device 1400 may comprise various operatively interconnected electronic components which can include one or more of signal processing components, control components, RF front-end components, microprocessors, microcontrollers, memory (random access memory, flash memory or the like), integrated circuits, and the like.

Figure 15:
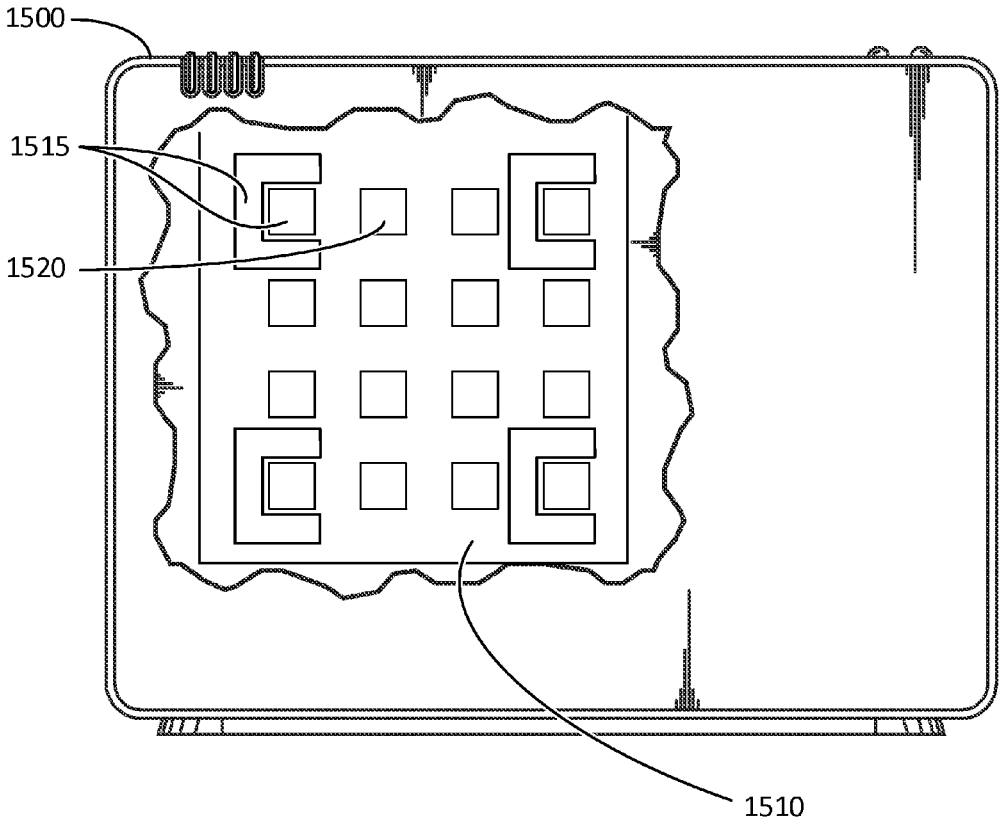
FIG. 15 illustrates a device such as a base station, wireless access point, wireless router device, or radar device comprising a PCB in accordance with embodiments of the present invention.

FIG. 15 illustrates a device such as a base station, wireless access point, wireless router device, or radar device communication device 1500 comprising a PCB 1510 comprising antenna elements, transmission line structures and/or SIW structures as described elsewhere herein. A wireless router device as defined herein can be used to refer to a small cell wireless router, for example a router for use in a Local Area Network (LAN) and the like. A wireless router device can further be used to define a device used in network infrastructure, for example a base station, an Evolved Node B (eNB) and the like. The device includes a PCB 1510 having an array of antenna elements which includes combination antenna elements 1515 interleaved with additional antenna elements 1520, similarly to the PCB 1410 illustrated in FIG. 14. The wireless router device 1500 may comprise various operatively interconnected electronic components which can include one or more of signal processing components, control components, RF front-end components, microprocessors, microcontrollers, memory (random access memory, flash memory or the like), integrated circuits, and the like.

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations or equivalents that fall within the scope of the present invention.

We claim:

1. A Printed Circuit Board (PCB) comprising:

a Substrate Integrated Waveguide (SIW) structure having a first conductive boundary disposed within a first conductive layer of the PCB, a second conductive boundary disposed within a second conductive layer of the PCB, and a plurality of first vias coupling the first conductive boundary to the second conductive boundary;

at least one waveguide antenna disposed at least partially within further conductive layers of the PCB, the further conductive layers including a third conductive layer and a fourth conductive layer, wherein the second conductive layer is disposed between the first conductive layer and the third conductive layer, and wherein the third conductive layer is disposed between the second conductive layer and the fourth conductive layer;

at least one aperture formed in the second conductive boundary of the SIW structure and aligned with the at least one waveguide antenna;

a conductive trace of a transmission line, the conductive trace disposed within the third conductive layer, at least a portion of the conductive trace aligned overtop of the second conductive boundary of the SIW structure, the conductive trace routed around the at least one aperture; and at least one further antenna disposed at least partially within the fourth conductive layer and operatively coupled to the conductive trace.

2. The PCB according to claim 1, wherein the SIW structure comprises a plurality of branches, each branch of the plurality of branches terminating at a respective location aligned with a corresponding one of a plurality of waveguide antennas including the at least one waveguide antenna, and wherein a plurality of apertures including the at least one aperture are formed in the second conductive boundary of the SIW structure and respectively aligned with the plurality of waveguide antennas.

3. The PCB according to claim 2, wherein the transmission line comprises a further plurality of branches, each branch of the further plurality of branches terminating at a respective location aligned with a corresponding one of a plurality of further antennas including the at least one further antenna, the plurality of further antennas disposed at least partially within the fourth conductive layer and operatively coupled to the transmission structure.

4. The PCB according to claim 3, wherein the plurality of waveguide antennas are disposed in a first two-dimensional array, and wherein the plurality of further antennas are disposed in a second two-dimensional array interleaved with the first two-dimensional array.

5. The PCB according to claim 1, wherein the second conductive boundary of the SIW is integral with a ground plane disposed within the second conductive layer, said ground plane extending into a region of the second conductive layer surrounding the SIW structure.

6. The PCB according to claim 1, wherein the transmission line is a stripline transmission line or a microstrip transmission line.

7. The PCB according to claim 1, wherein the transmission line is a stripline transmission line formed from the conductive trace in cooperation a first ground plane and a second ground plane, the first ground plane disposed on the second conductive layer and comprising the second conductive boundary, the second ground plane disposed on the fourth conductive layer and interleaved with conductive elements of the at least one further antenna.

8. The PCB according to claim 1, wherein the waveguide antenna comprises a pair of aligned, closed conductive traces formed respectively on the third conductive layer and the fourth conductive layer and a plurality of vias connecting the closed conductive traces, the closed conductive traces and the plurality of vias defining a perimeter of a non-conductive region of the waveguide antenna.

9. The PCB according to claim 1, wherein the further antenna is a patch antenna having a conductive body which is laterally offset from the at least one waveguide antenna.

10. The PCB according to claim 1, wherein the further antenna has a conductive body which defines a perimeter of a cavity in the plane of the fourth conductive layer, and wherein the waveguide antenna is at least partially disposed within the cavity.

11. The PCB according to claim 10, wherein the conductive body of the patch antenna is a C-shaped body.

12. The PCB according to claim 1, wherein some of the first vias include portions extending to and integral with conductive portions of the waveguide antenna.

13. The PCB according to claim 1, further comprising a Coplanar Waveguide (CPWG) structure disposed on the first conductive layer and operatively coupled to the SIW structure through an impedance matching structure disposed at an interface between a port of the CPWG structure and a port of the SIW structure, the impedance matching structure at least partially disposed on the first conductive layer.

14. The PCB according to claim 13, wherein the CPWG structure comprises a central conductive trace disposed between a first pair of elongated dielectric regions having a first width, wherein the impedance matching structure comprises an extension of the central conductive trace surrounded by a second pair of dielectric regions aligned with the first pair of dielectric regions and having a second width greater than the first width, and wherein the central conductive trace of the CPWG structure is conductively coupled to the first conductive boundary of the SIW at the port of the SIW structure.

15. The PCB according to claim 1, further comprising a Coplanar Waveguide (CPWG) structure disposed on the first conductive layer or the fourth conductive layer and operatively coupled to the transmission line using a via, the via connecting the conductive trace of the transmission line with a central conductive trace of the CPWG structure.

16. The PCB according to claim 1, wherein the second conductive layer and the third conductive layer are separated by a dielectric layer having a thickness between 4 mil and 12 mil.

17. The PCB according to claim 1, further comprising at least a partial via fence formed between the second conductive and the third conductive layer and at least partially surrounding the at least one aperture.

18. A method of manufacturing a PCB, the method comprising:

forming a Substrate Integrated Waveguide (SIW) structure having a first conductive boundary disposed within a first conductive layer of the PCB, a second conductive boundary disposed within a second conductive layer of the PCB, and a plurality of first vias coupling the first conductive boundary to the second conductive boundary;

forming at least one aperture in the second conductive boundary of the SIW structure and aligned with the at least one waveguide antenna;

forming at least one waveguide antenna disposed at least partially within further conductive layers of the PCB, the further conductive layers including a third conductive layer and a fourth conductive layer, wherein the second conductive layer is disposed between the first conductive layer and the third conductive layer, and wherein the third conductive layer is disposed between the second conductive layer and the fourth conductive layer;

forming a conductive trace of a transmission line, the conductive trace disposed within the third conductive layer, at least a portion of the conductive trace aligned overtop of the second conductive boundary of the SIW structure thereby facilitating operation of the transmission line, the conductive trace routed around the at least one aperture; and forming at least one further antenna disposed at least partially within the fourth conductive layer and operatively coupled to the transmission structure through a further via.

19. The method according to claim 18, further comprising:

forming a first sub-assembly comprising the first conductive layer and the second conductive layer separated by the first dielectric layer, the first sub-assembly having the SIW structure and the at least one aperture formed in the second conductive boundary of the SIW structure;

forming a second sub-assembly comprising the further conductive layers separated by the further dielectric layer, the second sub-assembly further comprising the at least one waveguide antenna, the conductive trace, and the at least one further antenna;

forming blind vias in one or both of the first sub-assembly and the second sub-assembly of the PCB while the first sub-assembly and the second sub-assembly are separate;

bonding the first sub-assembly to the second sub-assembly to form the PCB, the first sub-assembly separated from the second sub-assembly by a dielectric bonding layer disposed between the second conductive layer and the third conductive layer, the first sub-assembly and the second sub-assembly disposed relatively such that: at least a portion of the conductive trace is aligned overtop of the second conductive boundary of the SIW structure thereby facilitating operation of the transmission line;

the conductive trace routed around the at least one aperture; and the at least one aperture is aligned with the at least one waveguide antenna; and subsequently forming in the PCB one or more of: through vias passing from the first conductive layer to the fourth conductive layer; blind vias passing from the first conductive layer to the third conductive layer; and blind vias passing from the second conductive layer to the fourth conductive layer.

20. The method according to claim 18, wherein the second conductive layer and the third conductive layer are separated by a dielectric layer having a thickness between 4 mil and 12 mil.

21. A wireless communication device comprising a Printed Circuit Board (PCB), the PCB comprising:

a Substrate Integrated Waveguide (SIW) structure having a first conductive boundary disposed within a first conductive layer of the PCB, a second conductive boundary disposed within a second conductive layer of the PCB, and a plurality of first vias coupling the first conductive boundary to the second conductive boundary;

at least one waveguide antenna disposed at least partially within further conductive layers of the PCB, the further conductive layers including a third conductive layer and a fourth conductive layer, wherein the second conductive layer is disposed between the first conductive layer and the third conductive layer, and wherein the third conductive layer is disposed between the second conductive layer and the fourth conductive layer;

at least one aperture formed in the second conductive boundary of the SIW structure and aligned with the at least one waveguide antenna;

a conductive trace of a transmission line, the conductive trace disposed within the third conductive layer, at least a portion of the conductive trace aligned overtop of the second conductive boundary of the SIW structure, the conductive trace routed around of the at least one aperture; and at least one further antenna disposed at least partially within the fourth conductive layer and operatively coupled to the conductive trace.

22. The wireless communication device according to claim 21, wherein the wireless device is a hand held wireless communication device, a wireless router device, a base station, a wireless access point, or a radar device.

* * * * *